US006688394B1

(12) United States Patent
Ayling

(10) Patent No.: US 6,688,394 B1
(45) Date of Patent: Feb. 10, 2004

(54) DRILLING METHODS AND APPARATUS

(75) Inventor: Laurence J. Ayling, Camberly (GB)

(73) Assignee: Coupler Developments Limited, Douglas (GB)

( * ) Notice: Subject to any disclaimer, the term of this patent is extended or adjusted under 35 U.S.C. 154(b) by 4 days.

(21) Appl. No.: 09/703,178

(22) Filed: Oct. 31, 2000

Related U.S. Application Data

(63) Continuation-in-part of application No. PCT/GB99/03411, filed on Oct. 14, 1998, and a continuation-in-part of application No. 09/284,449, filed as application No. PCT/GB97/02815 on Oct. 14, 1997, now Pat. No. 6,315,051.

(30) Foreign Application Priority Data

| | | |
|---|---|---|
| Oct. 15, 1996 | (GB) | 9621509 |
| Oct. 15, 1996 | (GB) | 9621510 |
| Oct. 14, 1998 | (GB) | 98/22303 |
| Oct. 14, 1998 | (GB) | 98/22304 |

(51) Int. Cl.[7] ..... E21B 33/02
(52) U.S. Cl. ..... 166/380; 166/81.1; 175/218
(58) Field of Search ..... 175/72, 218, 207, 175/209, 215; 166/322, 325, 81.1, 373, 374, 380

(56) References Cited

U.S. PATENT DOCUMENTS

| | | | |
|---|---|---|---|
| 2,245,960 A | 6/1941 | Claire | |
| 2,758,654 A | 8/1956 | Simmons | |
| 2,877,977 A | 3/1959 | Allen | |
| 2,963,274 A | 12/1960 | Failing | |
| 3,144,085 A | 8/1964 | Hasha | |
| 3,190,370 A | 6/1965 | Kvell-Aune et al. | |
| 3,212,578 A | 10/1965 | Hasha | |
| 3,282,339 A | 11/1966 | Hasha | |
| 3,404,741 A | 10/1968 | Gheorghe et al. | |
| 3,463,231 A | 8/1969 | Hutchinson | |
| 3,486,560 A | 12/1969 | Hutchinson | |
| 3,559,739 A | 2/1971 | Hutchinson | 166/311 |
| 3,631,933 A | 1/1972 | Bryant | |

(List continued on next page.)

FOREIGN PATENT DOCUMENTS

| | | | |
|---|---|---|---|
| WO | 9927222 | 6/1999 | E21B/15/00 |

OTHER PUBLICATIONS

Foster, J.L., A Study of Various Methods of Drill String Make–up ASME, (1977).
Sullivan, W.N., A Wellbore Thermal Model, Sandia Lab. (1/76).
Varco, BJ, Advancing the Technology of Drilling.

(List continued on next page.)

*Primary Examiner*—Frank S. Tsay
(74) *Attorney, Agent, or Firm*—Bartlett & Sherer; Ronald B. Sherer

(57) ABSTRACT

A method for drilling wells in which the tubular (5) can be added or removed from the drill string (17) whilst the drill is rotating with the mud and drilling fluids being circulated continuously and kept separated from the environment to reduce pollution. A connector is used with an inlet (15) and outlet (10) for the mud etc. and which incorporates rams (11) to seal off and separate the flow of mud as a tubular is added or removed.

43 Claims, 31 Drawing Sheets

U.S. PATENT DOCUMENTS

| | | | |
|---|---|---|---|
| 3,722,603 | A | 3/1973 | Brown |
| 3,722,607 | A | 3/1973 | Ray |
| 3,757,858 | A | 9/1973 | Davis et al. |
| 3,797,570 | A | 3/1974 | Leutwyler |
| 3,888,318 | A | 6/1975 | Brown |
| 3,999,610 | A | 12/1976 | Sage et al. |
| 4,119,297 | A | 10/1978 | Gunther |
| 4,162,704 | A | 7/1979 | Gunther |
| 4,315,553 | A | 2/1982 | Stallings |
| 4,427,070 | A | 1/1984 | O'Brien |
| 4,512,216 | A | 4/1985 | Callegari, Sr. |
| 4,553,591 | A | 11/1985 | Mitchell |
| 4,640,362 | A | 2/1987 | Schellstede |
| 4,646,855 | A | 3/1987 | Dellinger |
| 4,655,291 | A | 4/1987 | Cox |
| 4,715,456 | A | 12/1987 | Poe et al. |
| 5,059,043 | A | 10/1991 | Kuhne |
| 5,215,151 | A | 6/1993 | Smith et al. |
| 5,284,210 | A | 2/1994 | Helms et al. |
| 5,314,209 | A | 5/1994 | Kuhne |
| 5,566,769 | A | 10/1996 | Stuart |
| 5,662,170 | A | 9/1997 | Donovan |
| 5,667,023 | A | 9/1997 | Harrell et al. |
| 5,679,894 | A | 10/1997 | Kruger et al. |
| 5,771,984 | A | 6/1998 | Potter et al. |
| 5,803,186 | A | 9/1998 | Berger et al. |
| 5,975,203 | A | 11/1999 | Payne et al. |
| 5,975,219 | A | 11/1999 | Sprehe |
| 5,988,274 | A | 11/1999 | Funk |

OTHER PUBLICATIONS

Zhang, YQ, Research and Development on the Hydraulic Reverse Circulation . . . , Abstracts, vol. I, (Aug. 1996).

Shaffer PCWD Systems, Reducing the Cost of Drilling.

Rotation of Top Drive and Lower Grips
= in idling mode
= in driving mode
Fluid flows of mud and flushings
= mud flow
F = flushing
10
30
29A
29D
18
23
26
24
25
1
2
3
4
5
6
31
F
F Fig. 11
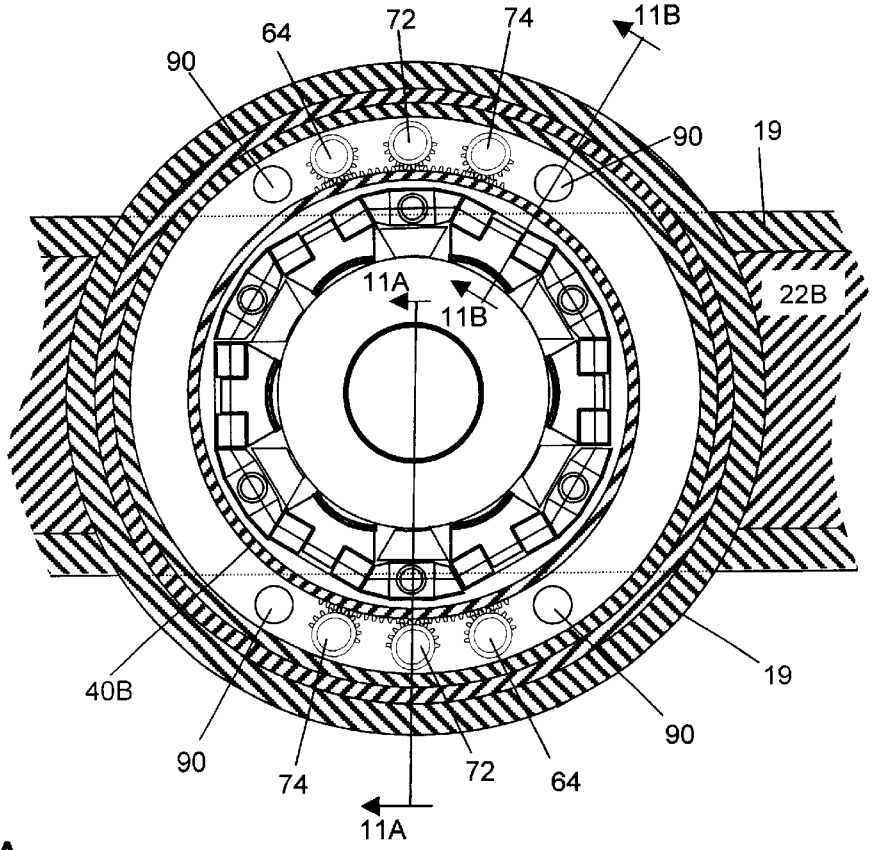
Fig. 11A
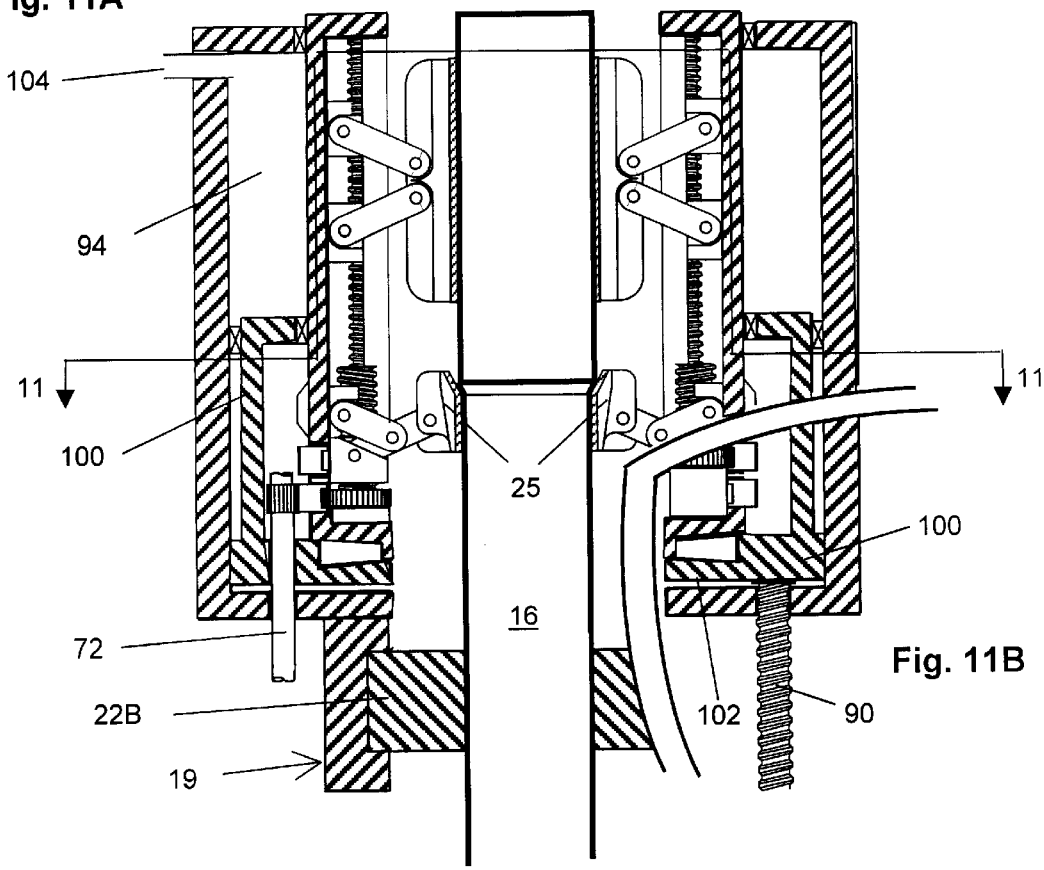
Fig. 11B Fig 12. Coupler Assembly with Internal Grips & Slips
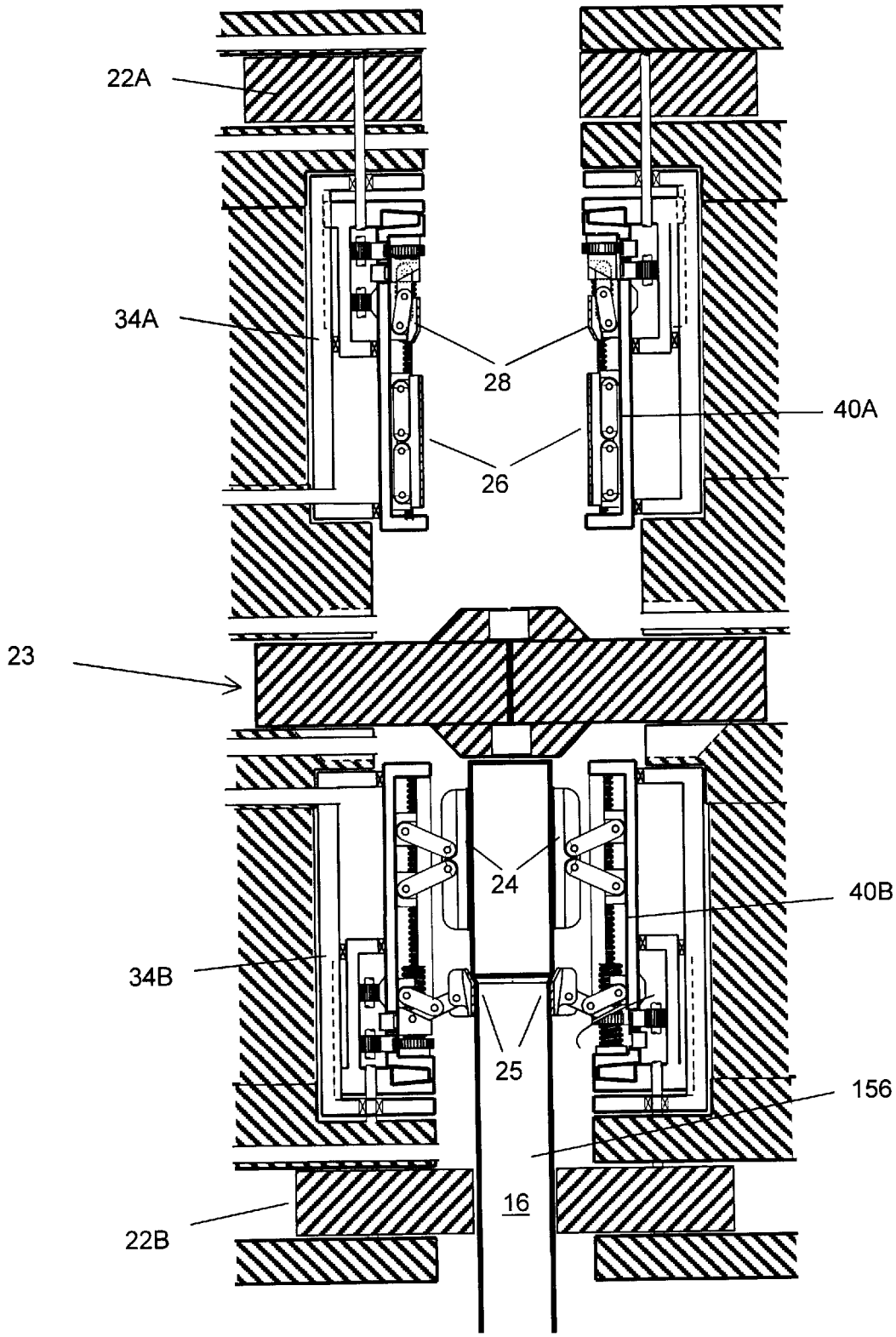

Fig 13. Upper & Lower Grips & Slips
(Connecting by raising drillstring and lowering tubing)
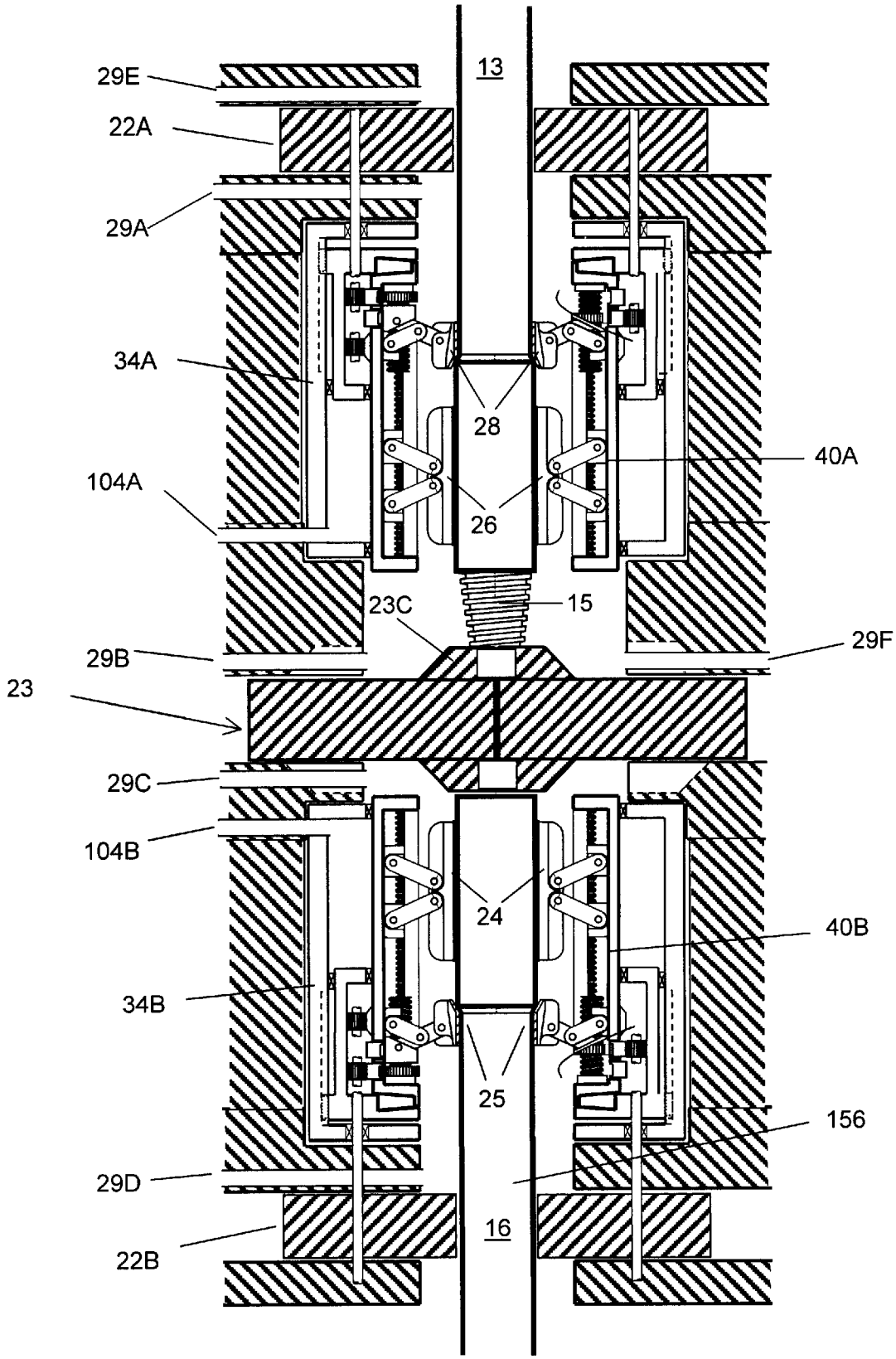

Fig 14. Upper & Lower Grips & Slips
(Connecting by raising drillstring and lowering tubing)
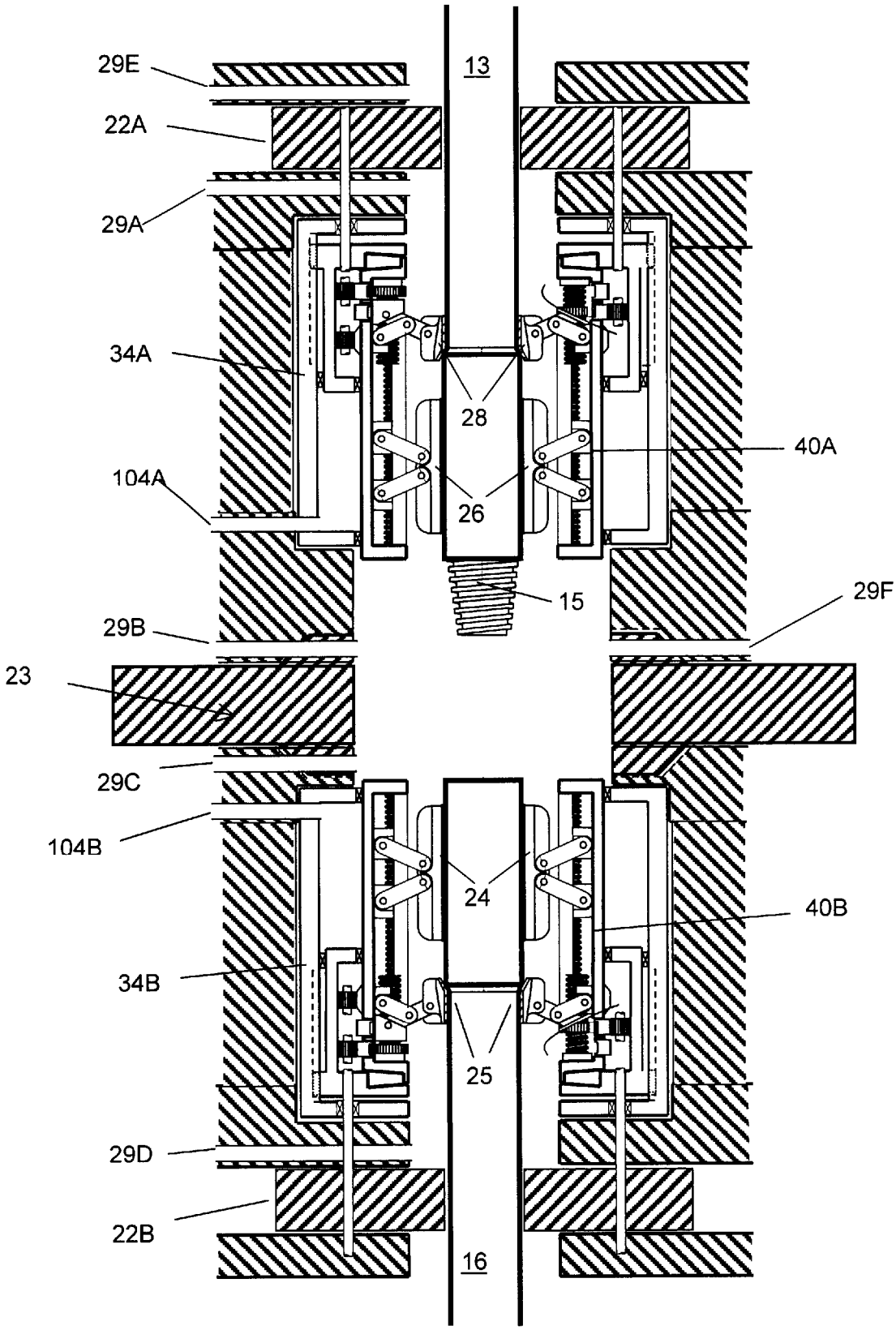

Fig 15. Upper & Lower Grips & Slips
(Connecting by raising drill string and lowering tubing)
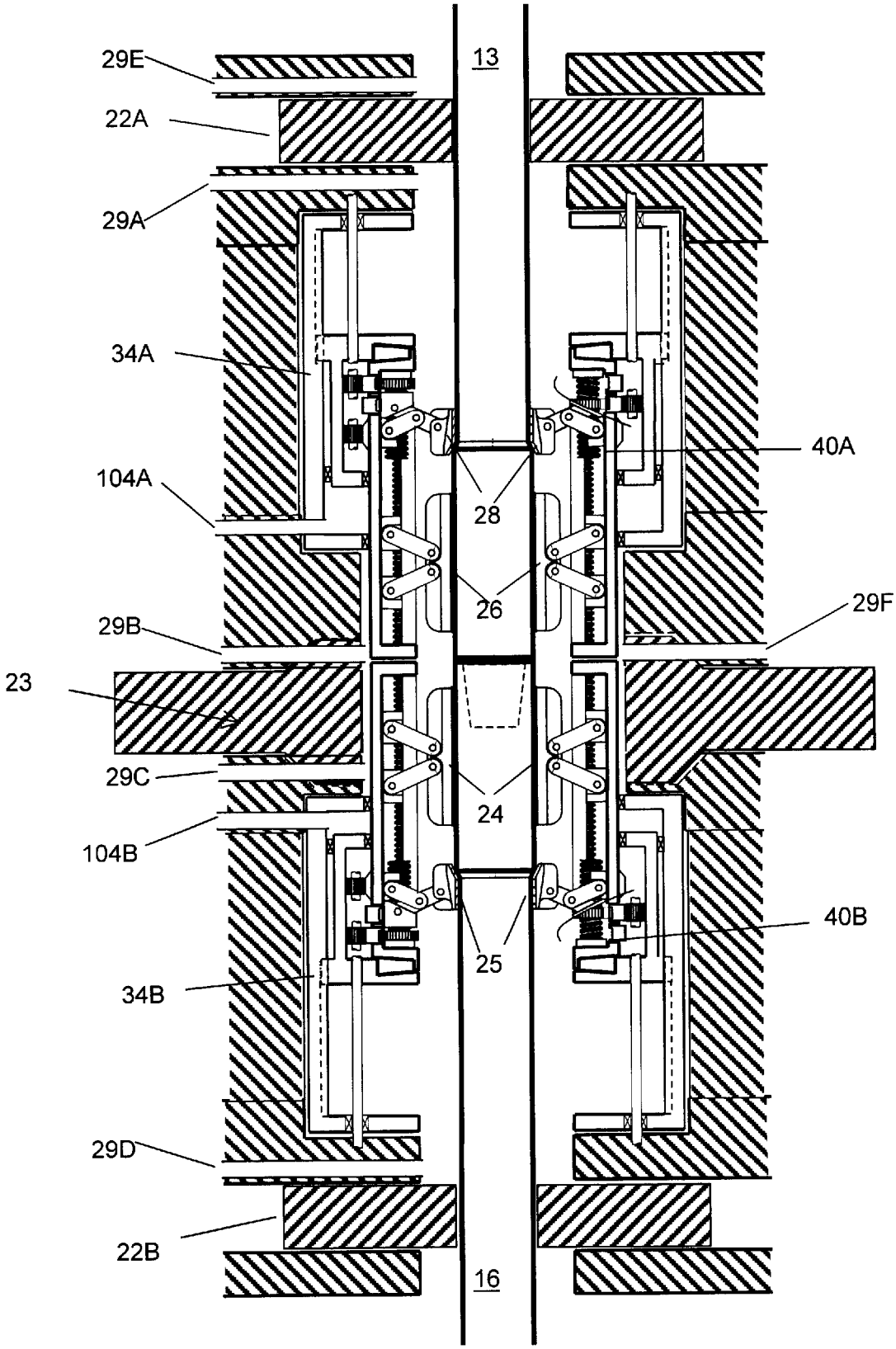

Fig 16. Coupler Assembly with internal Grips & Slips retracted
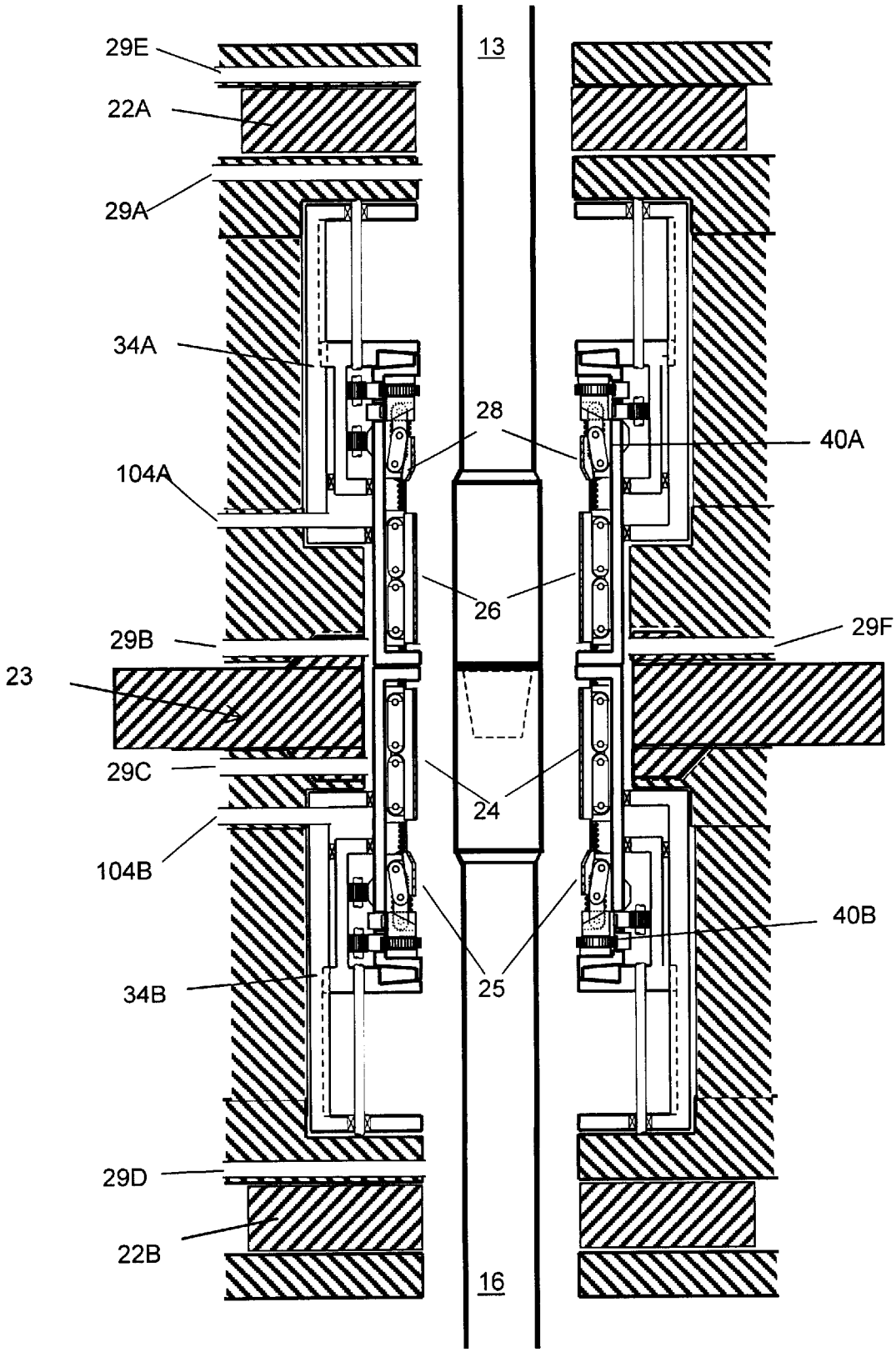

Fig. 17 Lower Grips & Slips
(Zero Travel Option)
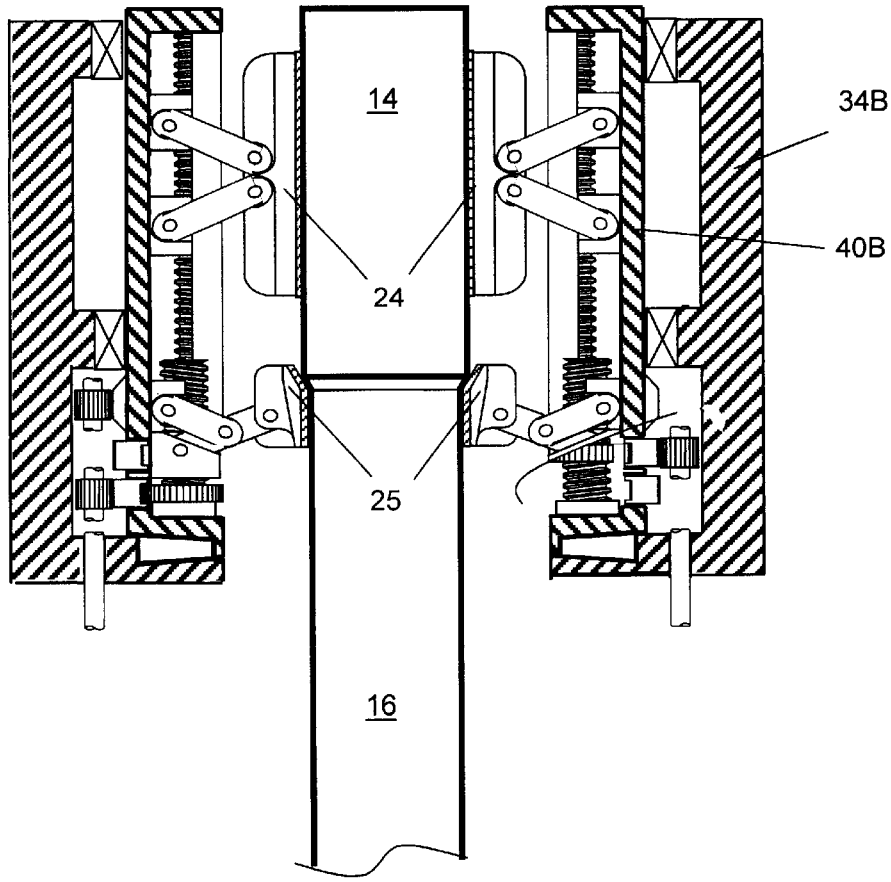

Fig. 18 Upper Grips & Slips
(Long Travel Option)
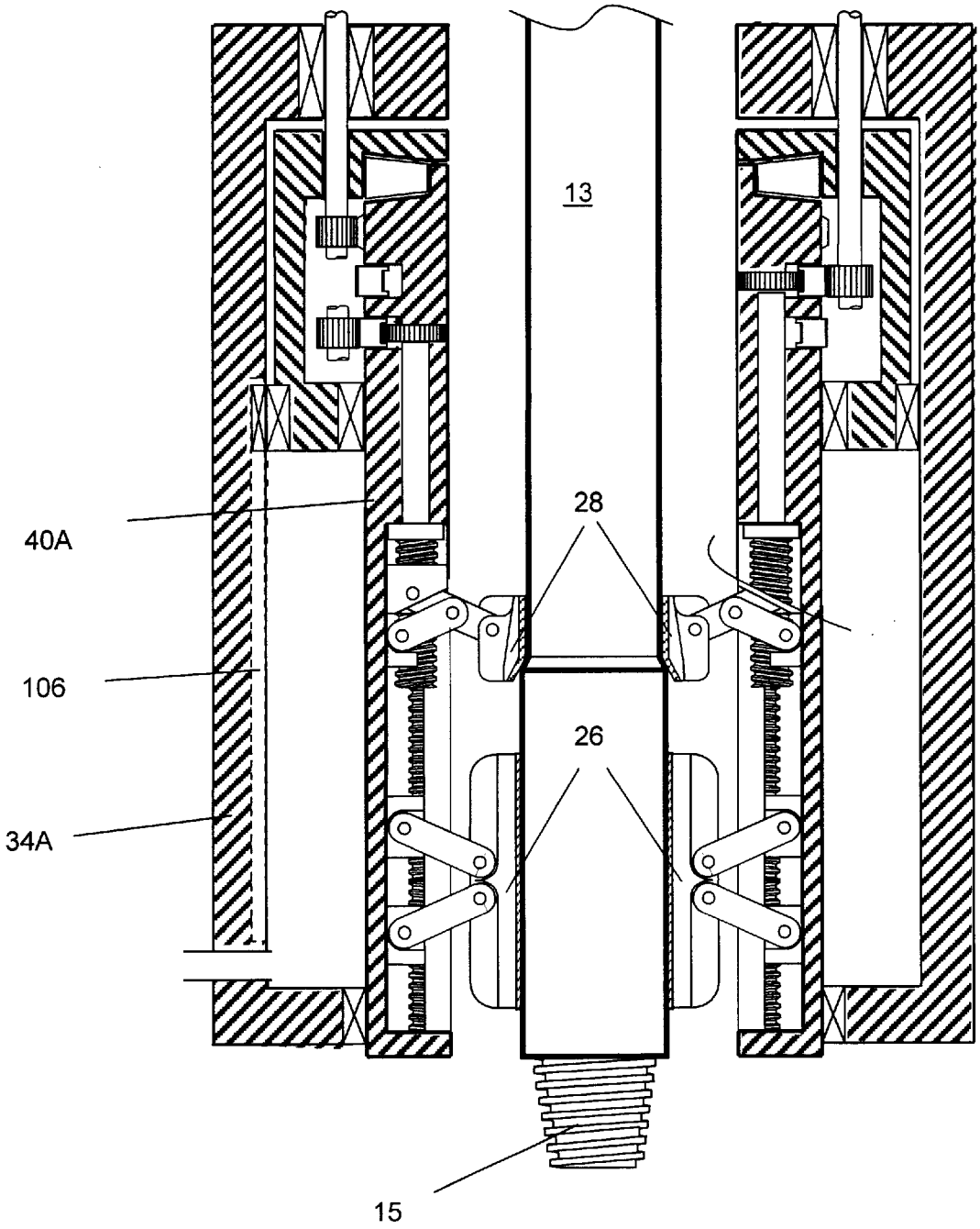

Fig. 19 Upper & Lower Grips & Slips
(Connecting without raising drill string)
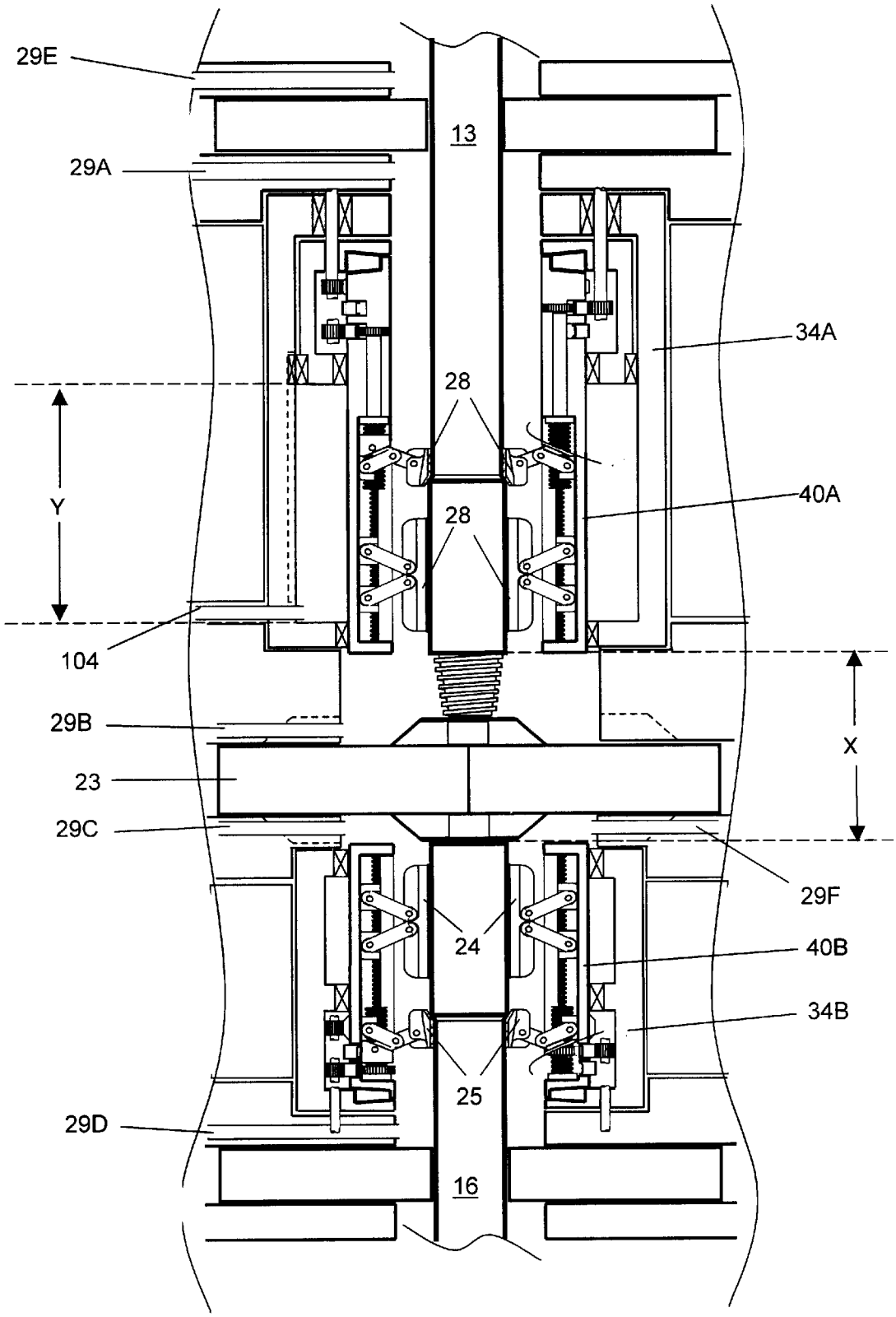

DRILLING METHODS AND APPARATUS

RELATED APPLICATONS

This Application is a Continuation-In-Part of U.S. application Ser. No. 09/284,449, filed Apr, 12, 1999, now U.S. Pat. No. 6,315,051, U.S. application Ser. No. 09/284,449 being a §371 Application of PCT/GB97/02815 having a Priority Date of Oct. 15, 1996 based upon G.B. Serial Nos. 9,621,509 and 9,621,510, and a continuation-in-part of Application PCT/GB99/03411 having a Priority Date of Oct. 14, 1998 based upon G.B. Serial No. 9,822,303.

FIELD

This invention relates to drilling wells, and more particularly, to methods and apparatus for drilling wells much more efficiently and effectively so as to substantially reduce the multi-million dollar cost of drilling a well.

BACKGROUND

It is well known in the drilling industry, and particularly in the field of drilling for oil, natural gas and other hydrocarbons, that drill strings comprise a large plurality of tubular sections, hereinafter "tubulars", which are connected by male threads on the pins and female threads in the boxes. It is also well known that such tubulars must be added to the drill string, one-by-one, or in "stands" of 2 or 3 connected tubulars, as the string carrying the drill bit drills into the ground; a mile more below ground being common in the oil drilling art. For various reasons during the drilling, and after the bore hole has been drilled, it is necessary to withdraw the drill string, in whole or in part. Again, each tubular or stand must be unscrewed, one-by-one, as the drill string is brought up to the extent required.

With prior art systems, each time that a tubular is added or removed it is necessary to stop the drilling process, and the circulation of drilling fluid. This presents a costly delay in the overall drilling operation. This is because the circulation of drilling fluids is extremely critical to maintaining a steady down hole pressure and a steady and near constant Equivalent Circulating Density (ECD) as is well known in the drilling art. Also, when tripping the drill string into or out of the well, the lack of continuous circulation of a drilling fluid causes pressure changes in the well which increases the probability of "kicks" as is well known.

In addition to the drilling operation, the placement of casings in the bore hole is also necessary. As in the case of tubulars, the placement of casing sections in the prior art presents the same fundamental problems. That is, the flow of drilling fluids must be halted, and the drill string must be withdrawn in its entirety before the casing can be run into the well, which in some instances requires circulation of fluids and rotation of the casing.

SUMMARY

The present invention substantially reduces the time and cost of drilling operations by making it possible to continuously circulate drilling fluids while tubulars are added or removed, and also as casing strings are run into the bore hole. In addition, the present invention makes it possible to continue to rotate the drill string, if desired, while adding or removing tubulars. Bearing in mind that hundreds of tubulars are required per mile of drill string, the present invention eliminates hundreds of interruptions of the circulation of drilling fluids, and a like number of breaks in the rotation of the drill string and the drilling operation per mile of drilling.

BRIEF DESCRIPTION OF DRAWINGS

FIGS. 4A–6A are simplified, side elevational schematics of the operational mode of the embodiment of the invention shown in FIG. 3;

FIG. 11 is a cross-sectional view taken along view line 11—11of FIG. 11A.

FIGS. 11A and 11B comprise a composite cross-sectional view taken along view lines 11A and 11B of FIG. 11;

FIGS. 12 to 19 are elevational views, partly in cross-section illustrating the relative positions of the components as a new tubular is connected to the string;

DETAILED DESCRIPTION

Figure 1:
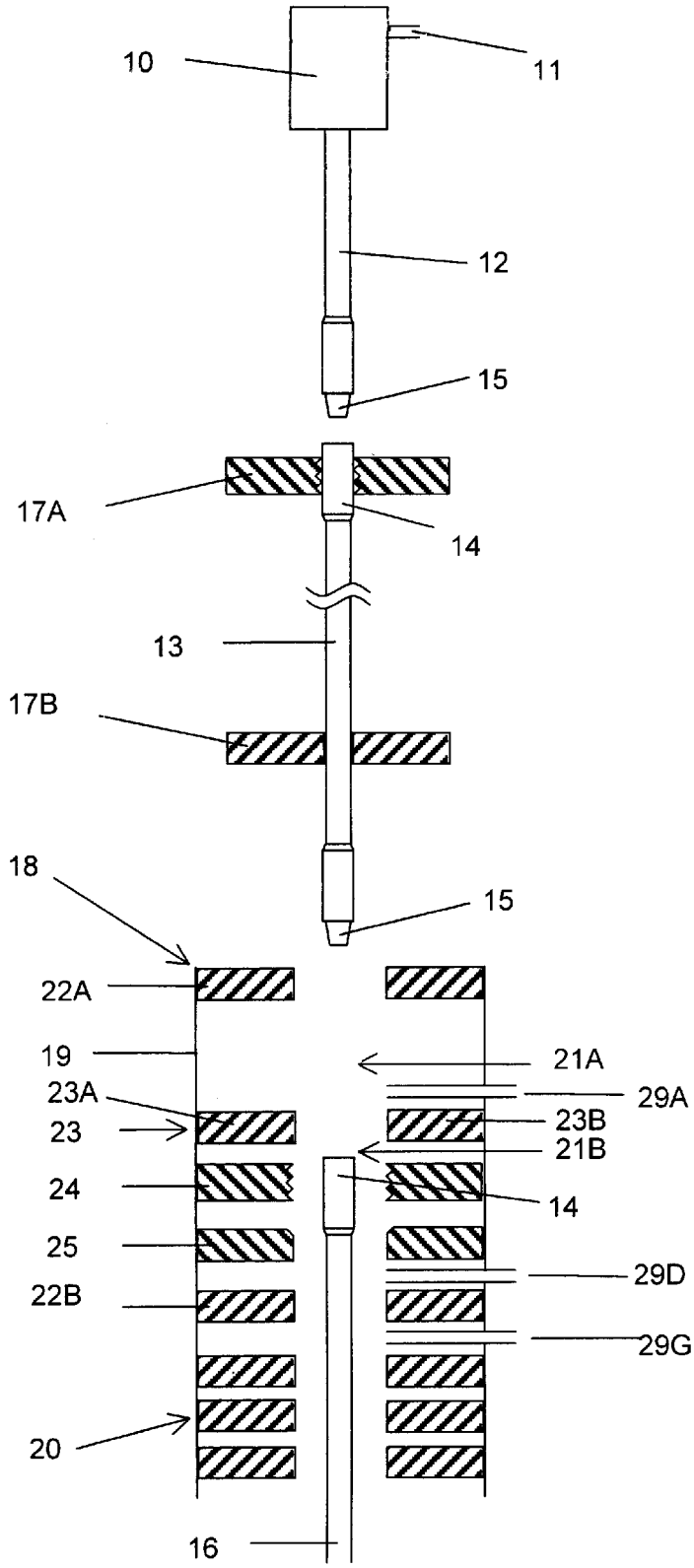
FIGS. 1–3 are simplified, side elevational schematics of the structural elements of three embodiments of the present invention.

Referring first to FIG. 1, numeral 10 indicates a conventional power drive, known in the art as a "top drive", and the top drive is provided with an inlet 11 for receiving drilling fluid as is well known. Top drive 10 carries a conventional "saver sub" 12, and tubular 13 includes a threaded male pin 15 and a threaded female box 14 or upset as is conventional in oil drilling. Tubular 13 may be positioned vertically above drill string 16 by known handlers 17A–17B. Of course, instead of tubulars, it will be understood that casing sections may be similarly positioned by the handlers for insertion into the bore hole by the present invention.

Surrounding string 16 is one example of a preferred coupler 18 according to the principles the present invention. Coupler 18 comprises a pressure resistant hull or casing 19, which may be integral with a stack 20 of conventional blow out preventers (BOP's). In the embodiment of FIG. 1, coupler 18 includes a plurality of elements in vertical arrangement as follows. Numerals 22A and 22B indicate upper and lower high pressure fluid seals. In this regard it will be understood that such seals may be conventional BOP's or RBOP's or annular preventers as known, or may be any other type of seal capable of withstanding the particular fluid pressure in a given drilling operation. Below seal 22A is a valve 23 which is illustrated as having horizontally movable valve portions 23A and 23B. These portions may be moved from the open position as shown to a closed position in which the valve portions engage each other to form a fluid tight seal. Thus, valve 23 divides coupler 18 into upper and lower chambers 21A and 21B which may be fluid sealed from each other. For example, it will be understood that valve 23 may comprise a slide valve, or a ram preventer, or blind preventer, as these terms are known in the drilling art, or other structures which may be opened and closed such as to form a fluid tight seal between the upper and lower chambers of the coupler; valve 23 being hereinafter referred to as a "valve" or "blind preventer".

Below valve 23 are lower rotary grips 24, and below them are slips 25. In this regard it will be understood that the grips may be motorized roller grips, or of other conventional designs motorized to rotate about their vertical axes, and the slips are support elements which have a central aperture smaller than the diameter of box or upset 14. While the grips 24 and slips 25 are shown as being separate elements in some Figures, the grips and slips may be integrated into a single unit and motorized so that both may be rotated and moved radially inwardly and outwardly as one element. It will also be noted that a plurality of inlets/outlets are provided, such as 29A, B and C for example, for the flow of drilling fluids and other fluids as will be further explained.

Figure 2:
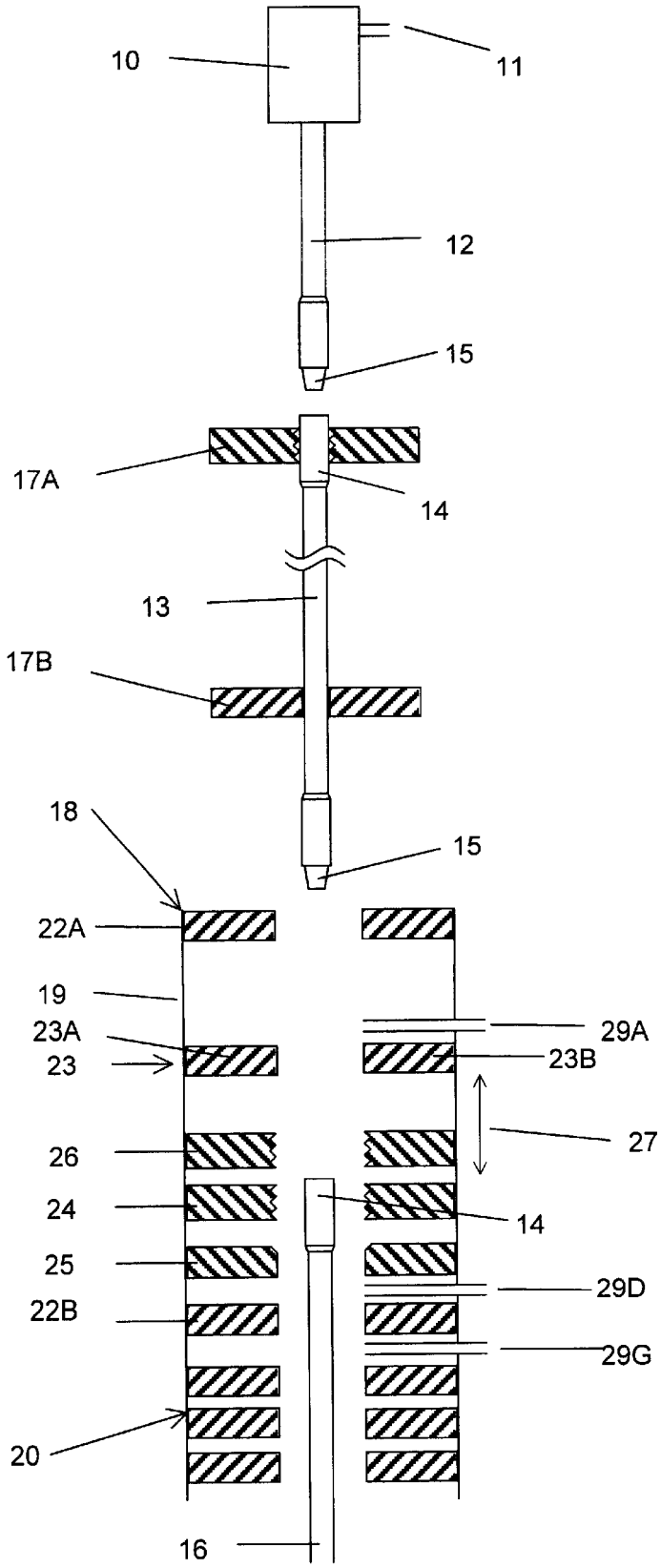
Figure 3:
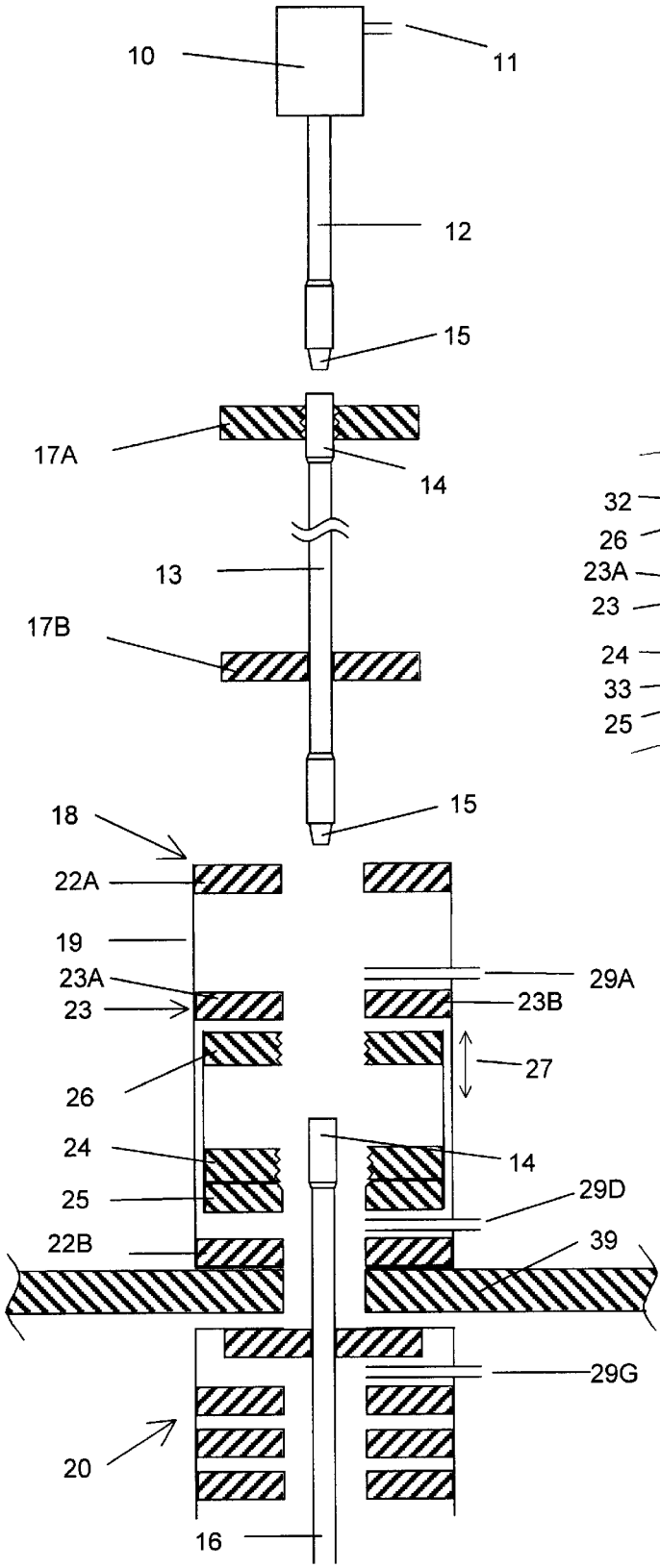

The embodiment of FIG. 2 is the same as that in FIG. 1 except that an additional set of upper rotary grips 26 is provided for the reason to be more fully explained hereinafter. Similarly, the embodiment of FIG. 3 is similar to the FIG. 2 embodiment except that upper grips 26, lower grips 24 and lower slips 25 may be one, single, integrated unit. Also, arrows 27 in FIGS. 2 and 3 indicate that lower and/or upper grips may be moved vertically, along the longitudinal axis of the drill string, as will be more fully described hereafter. It will also be noted that instead of coupler 18 and BOP stack 20 being integrated with the coupler on top of the stack, the coupler and BOP stack may be separate units with the coupler supported by the rig floor 39.

Figure 3A:
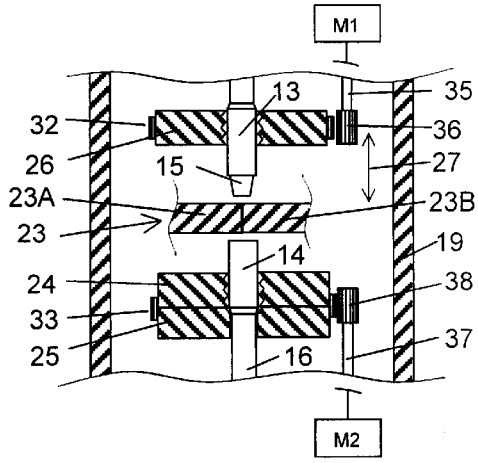
FIG. 3A is a simplified elevational view, partly in cross-section, further illustrating one embodiment of the invention.
Figure 4A:
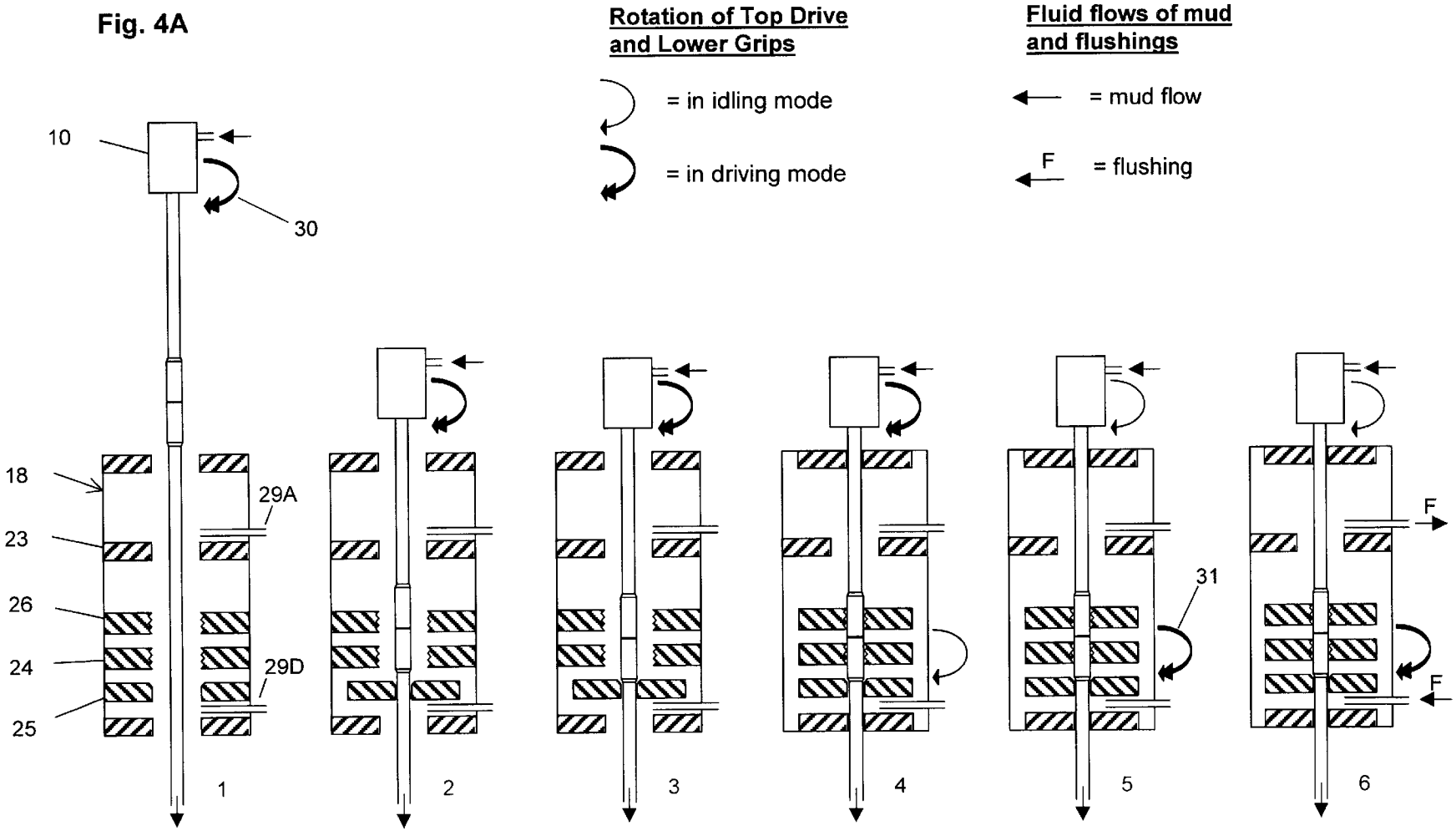
Figure 4B:
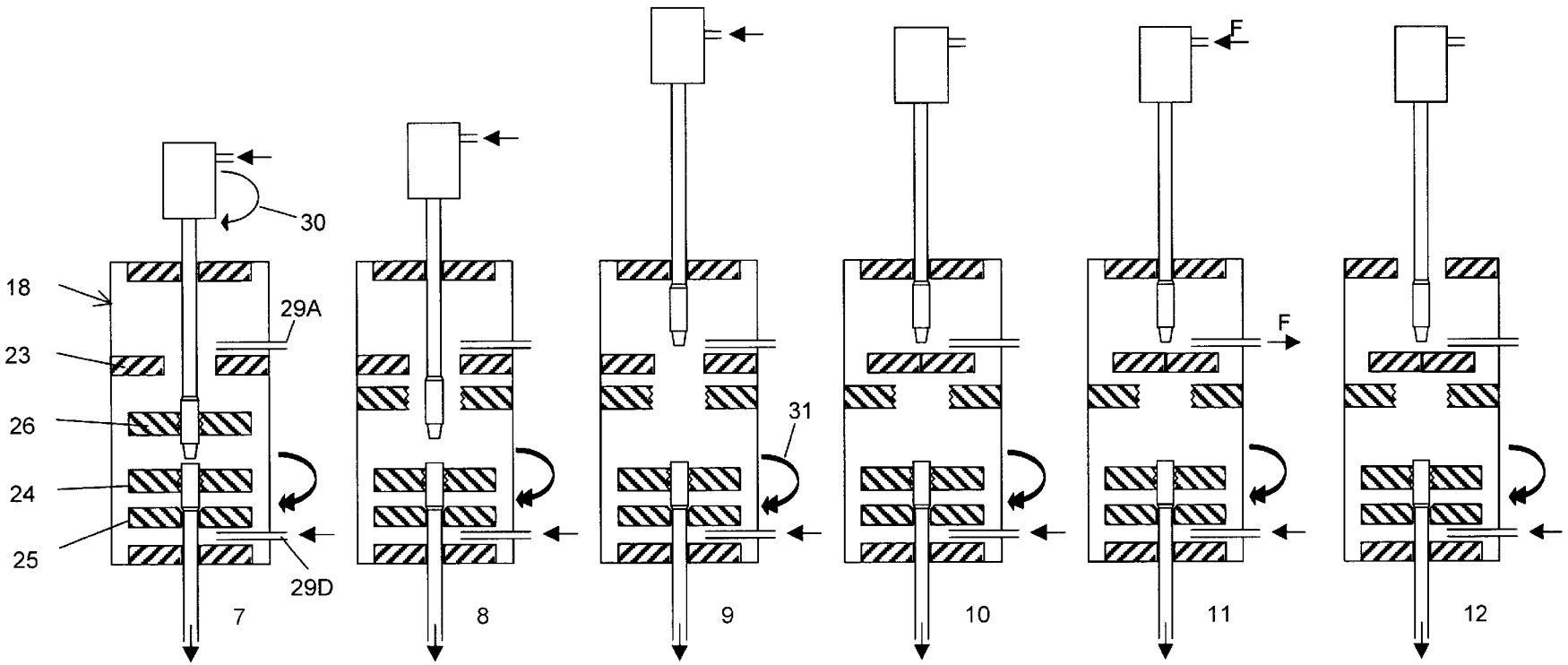
Figure 5A:
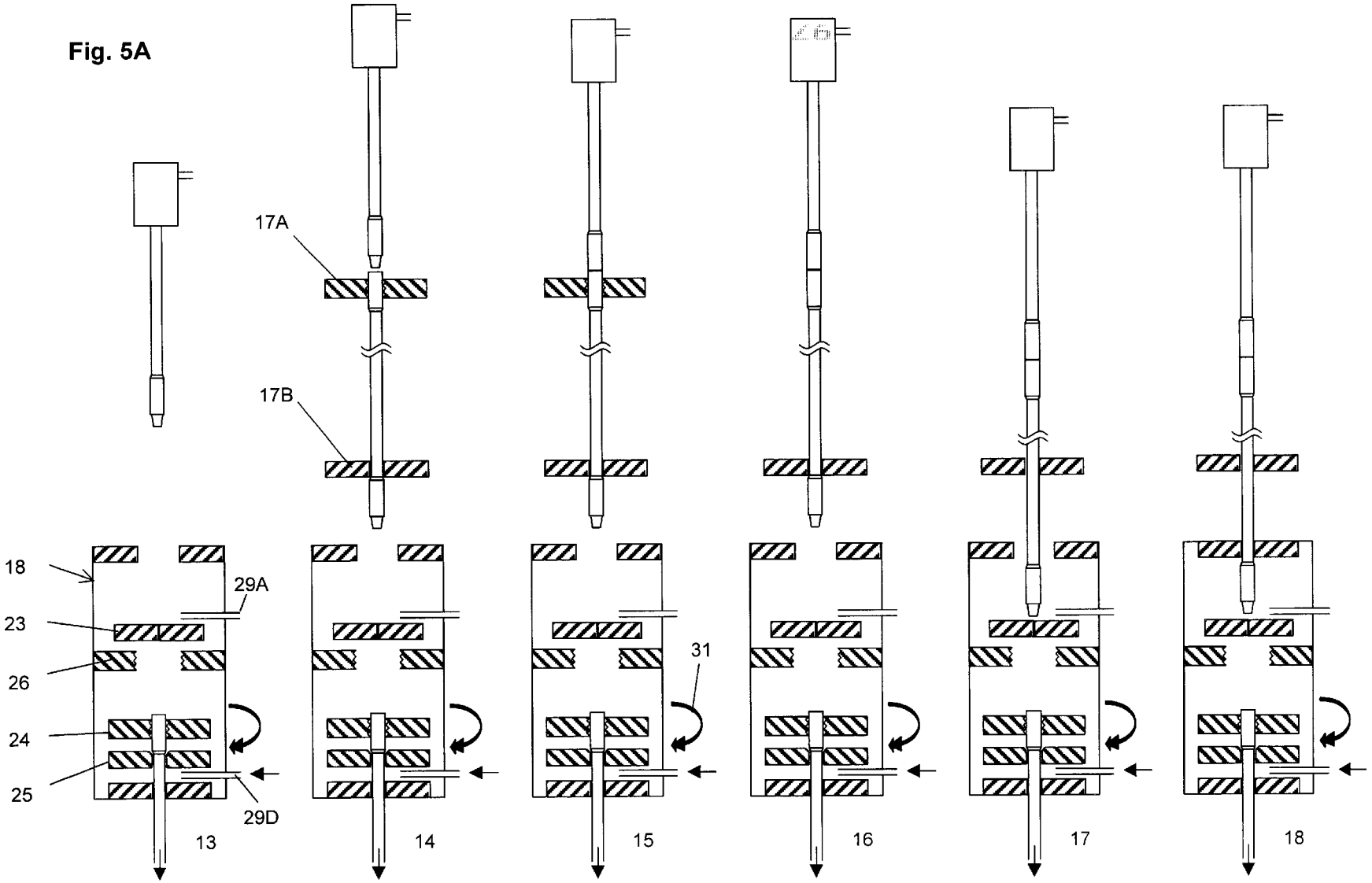
Figure 5B:
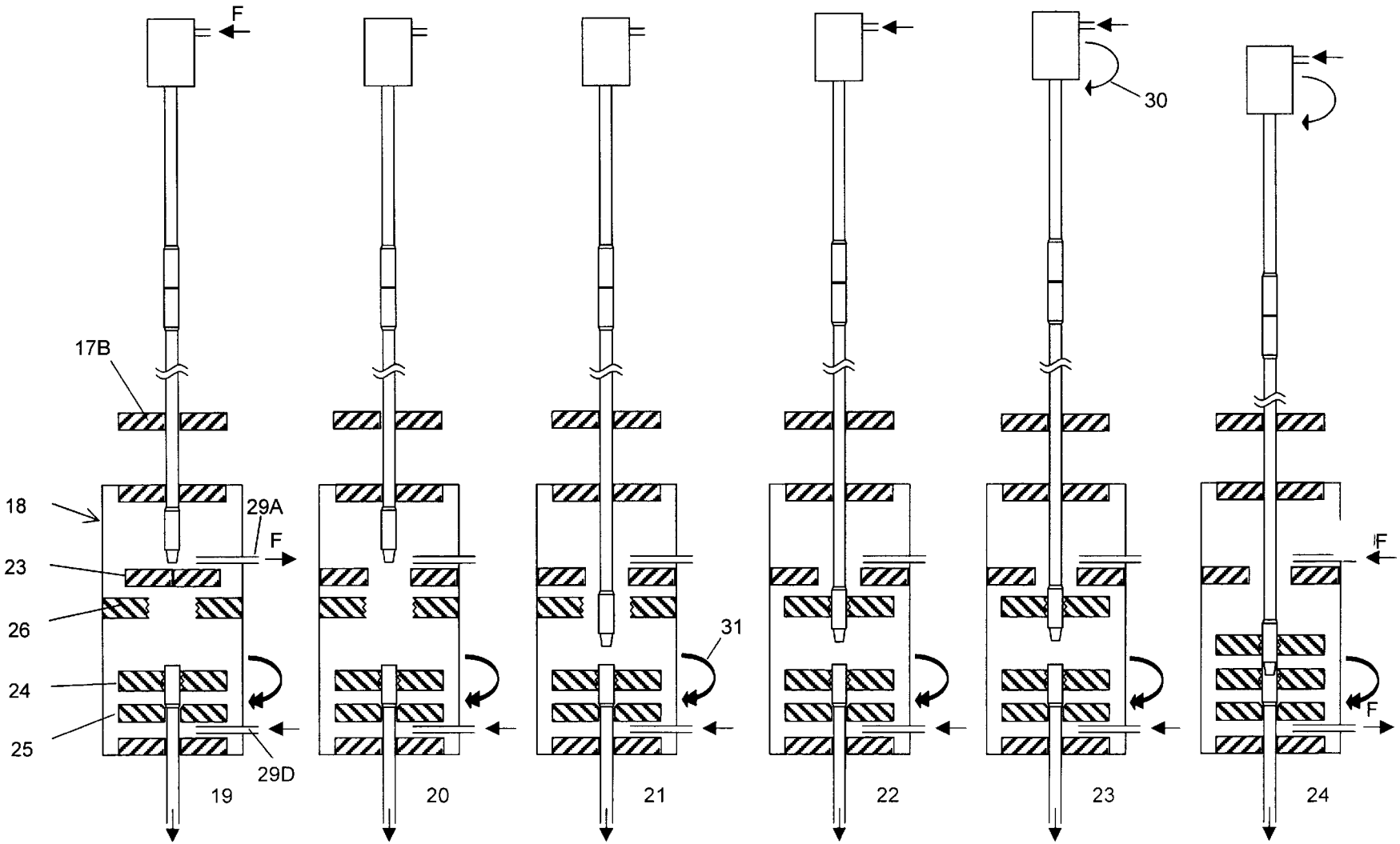
Figure 6:
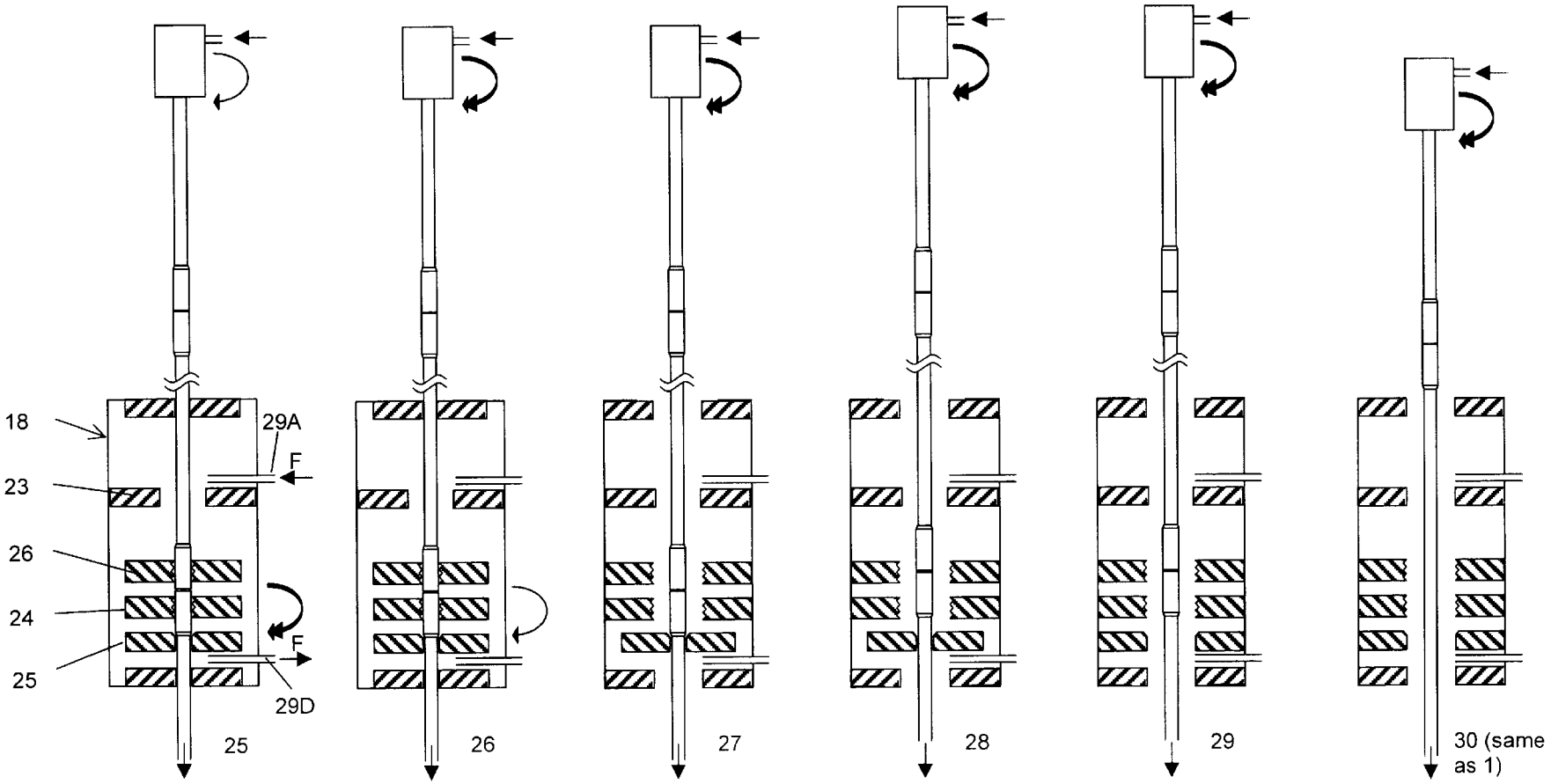

With respect to the motorized grips 24 and 26, it will be apparent that one or both of the conventional rotary grips may be motorized as shown schematically in FIG. 3A. For example, the upper and lower grips may be provided with ring gears 32 and 33 which may by driven by drive gears 36 and 38 through shafts 35 and 37 by motors M-1 and M-2. Thus, each of the grips 24 and 26 may be held stationary or rotated about the longitudinal axis of the string and tubular as will be more fully described hereafter.

FIGS. 4A–6A illustrate, and Table I describes in detail, one mode of steps whereby the FIGS. 2 and 3 embodiments may continuously maintain the flow of drilling fluid into and out of the bore hole while tubulars are added to the drill string. In these FIGS., arrows 30 indicate rotation of the top drive and arrows 31 represent the rotation of the grips within casing 19. The bold arrows indicate the driving element, and the lighter arrows indicate that the element is idling and being driven by the other element. With respect to the FIG. 1 embodiment, it will be understood that the operation is the same, except that, without upper grips 26, top drive 10 is used to rotate the tubular relative to the string in order to make or break the threaded connection therebetween. It will also be understood by those skilled in the drilling art that upper slips may be provided in the FIGS. 1–3 embodiments.

While the steps of the new method of the present invention are apparent from Table I and FIGS. 4A–6A, the following highlights should be noted. This method

TABLE I

| | Adding one pipe, or stand of pipes, to the drill string Activity sequence for one cycle | | |
|---|---|---|---|
| Activities: | 'Top drive' | 'Coupler | 'Handlers' |
| 1. | Drilling or 'tripping in' | Disengaged | — |
| 2. | — | Rotate & close slips | — |
| 3. | Lower 'upset' onto slips | — | — |
| 4. | — | Rotate & close grips and close annular preventers | — |
| 5. | Rotate tubular passively (idle) | Rotate lower grips actively (drive) | — |
| 6. | — | Flushing mud in & air out | — |
| 7. | Raise tubular passively | Break tool joint & back off | — |
| 8. | Hold position | Release upper grips | — |
| 9. | Raise to clear blind preventer | — | — |
| 10. | Stop circulation | Close blind preventer | — |
| 11. | Flushing mud out & air in | — | — |
| 12. | — | Open upper annular preventer | — |
| 13. | Rise up to accept new pipe | — | — |
| 14. | — | — | Handlers offer up new pipe to top drive |
| 15. | Lower & make up tool joint | — | — |
| 16. | — | — | Top handler releases |
| 17. | Lower pipe to blind preventer | — | Lower handler guides |
| 18. | — | Close upper annular preventer | — |
| 19. | Flushing mud in & air out | — | Lower handler restrains |
| 20. | — | Open blind preventer | — |
| 21. | Lower pipe to upper grips | — | — |
| 22. | — | Close upper grips | — |
| 23. | Rotate passively (Idle) | Rotate upper grips actively (drive) | — |
| 24. | Lower passively | Make up tool joint | — |
| 25. | — | Flushing mud out & air in | — |
| 26. | Rotate tubular actively (drive) | Rotate lower grips passively (idle) | Handlers disengage |
| 27. | — | Open & stop rotating both grips & open annular preventers | |
| 28. | Raise drill string off slips | — | — |
| 29. | — | Open & stop rotating slips | — |
| 30 = 1 | Carry on drilling or 'tripping in' and repeat cycle. | Disengaged | — |

Notes:
'Flushing mud in & air out' includes bringing the space up to full mud pump pressure
'Flushing mud out & air in' includes de-pressuring the space to atmospheric pressure utilizes the top drive to provide the downward force necessary to push the tubular into the coupler against the pressure therein. Accordingly, this method is more applicable to adding individual tubulars, rather than stands, and it will be understood that conventional top drives may be modified to produce greater downward force than usual depending upon the degree of pressure in a particular application. For example, conventional top drives can only be used for pressures in the bore hole and in the coupler up to about 500 psi. Above this pressure, and particularly in the range of 1,000 to 5,000 psi which are frequently encountered, conventional top drives must be modified with stronger structural support and bearings in order to counteract the higher pressures. At these very high pressures it will also be understood that the handlers guide the tubulars and, if necessary, prevent any buckling of the tubulars.

In activity 1, the string is drilling in the conventional mode and is driven by top drive 10, although other forms of drive will become apparent hereinafter. In activities 2 and 3, lower slips 25 have closed about the string, and box 14 has been lowered onto the slips while mud or other drilling fluid continues to be supplied through the top drive to the string. In activity 4, the upper and lower grips engage the tubular and the string, respectively, and rotate with them. In activity 5, the lower grips take over while the top drive begins to idle in its rotation. In activity 6, mud or other drilling fluid is flushed through the coupler and the coupler is pressurized. In activity 7, the saver sub is unscrewed from the string such as by slower rotation of the upper grips relative to the lower grips. In activity 8, valve 23 remains open as the top drive rises and upper grips 26 open and release the saver sub. The top drive and saver sub continue to rise as shown in activity 9 while mud continues to be supplied to and through the top drive, as well as through passage 29B. In activity 10, valve 23 closes and circulation of the mud or other drilling fluid through the top drive is stopped. However, a continued flow of fluid is effected through passage 29B, the lower chamber of the coupler and down through the string. In activity 11, the mud or other drilling fluid is flushed through inlet passage 29B and outlet passage 29A, and the fluid is replaced by air at atmospheric pressure. Also, lower grips 24 may continue to rotate the drill string through activities 5 to 25 if continuous rotation of the string is desired with or without continuous drilling. Activity 12 shows that the flushing has been completed and the supply of mud or other drilling fluid to the top drive and through the saver sub has stopped. In activity 13, the saver sub has been fully retracted and valve 23 remains closed. Drilling fluid continues to be supplied through passage 29B and down through the string, and it will be noted that this supply of drilling fluid continues through all of activities 13 to 24. In activity 14, the handlers 17A and 17B deliver a new tubular, which is connected to the saver sub in activity 15. In activities 16 to 18, the lower end of the new tubular is lowered into the upper chamber by handler 17B, and the upper annular preventers or seals 22A are closed and sealed about the new tubular. Of course, the mud or other drilling fluid continues to be supplied to the bore hole by supply to and through the lower chamber as previously described, and valve 23 remains closed and sealed. In activity 19, the upper chamber is flushed and depressurized through passage 29A prior to opening of the valve as shown in activity 20. In activity 21 the new tubular is lowered and guided by handler 17B, and in activity 22 the new tubular is gripped by upper grips 26. Throughout these activities, drilling fluid is resumed through the top drive, saver sub and the new tubular to the drill string; the flow of drilling fluids through the top drive and through passage 29B being overlapping and mixed within the lower chamber. In activities 23–24, upper grips 26 rotate the new tubular relative to the string and thereby make the connection. In this regard, it will be understood that the required relative rotation and torquing may be accomplished by rotation of the new tubular while the string is held stationary, or by rotation of both the tubular and the string in the same direction but at different rotational speeds. Thus, the connection, or disconnection, of a tubular may be accomplished with the string held stationary, or while continuing to rotate the string as desired.

In activities 24 to 30, the supply of drilling fluid to and through the top drive is continued while both chambers are flushed in activity 25, and the rotational driving of the new tubular is resumed by the top drive with the grips idling as shown in activity 26. In activity 27 the upper and lower seals 22A and 22B are opened, as are valve 23 and grips 24 and 26. These conditions are continued in activities 27 to 30 while lower slips 25 are opened in activity 29 and the top drive begins to lower the drill string in the normal drilling operation as described in activity 1. Of course, the removal of a tubular or stand is accomplished by performing the above-described activities in reverse order, while continuing to supply the necessary fluids to the bore hole, and while continuing to rotate the drill string with or without further drilling.

Figure 7:
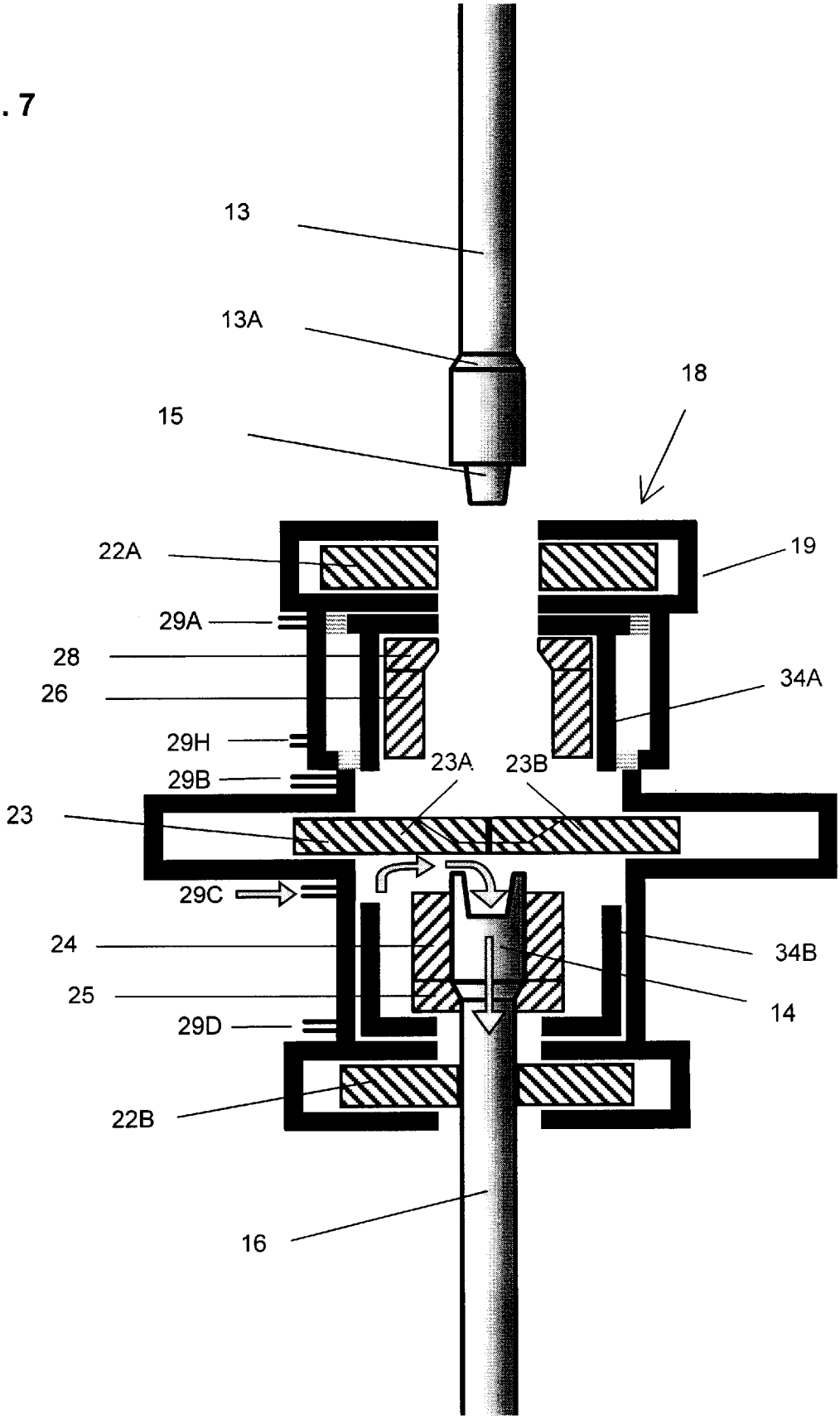
FIG. 7 is a schematic elevational view in cross-section of one preferred embodiment of the present invention.

Referring to FIG. 7, another preferred embodiment of the invention is illustrated with the same elements numbered with the same numerals as in FIGS. 1–3. In addition, numeral 34A indicates the carrier for vertical and rotary movement of the upper grips and slips and numeral 34B indicates the carrier for rotary movement of the lower grips 24 and slips 25; both of the upper and lower slips and grips being illustrated as being integral. As shown most clearly shown in FIGS. 8C to 8F, the mating portions 23A and B of valve 23 are designed of a size and shape so as to be able to open to a diameter greater than that of the upper grips and carrier 34A. Thus, the lower end of each tubular may be lowered below valve 23, and coupled with the upper tubular of the string in the lower portion of coupler 18. In this schematic, the inlet/outlets are shown for the flow of drilling fluids such as mud and for hydraulic fluid to move carrier 34A vertically as will be further explained hereinafter.

Figure 8:
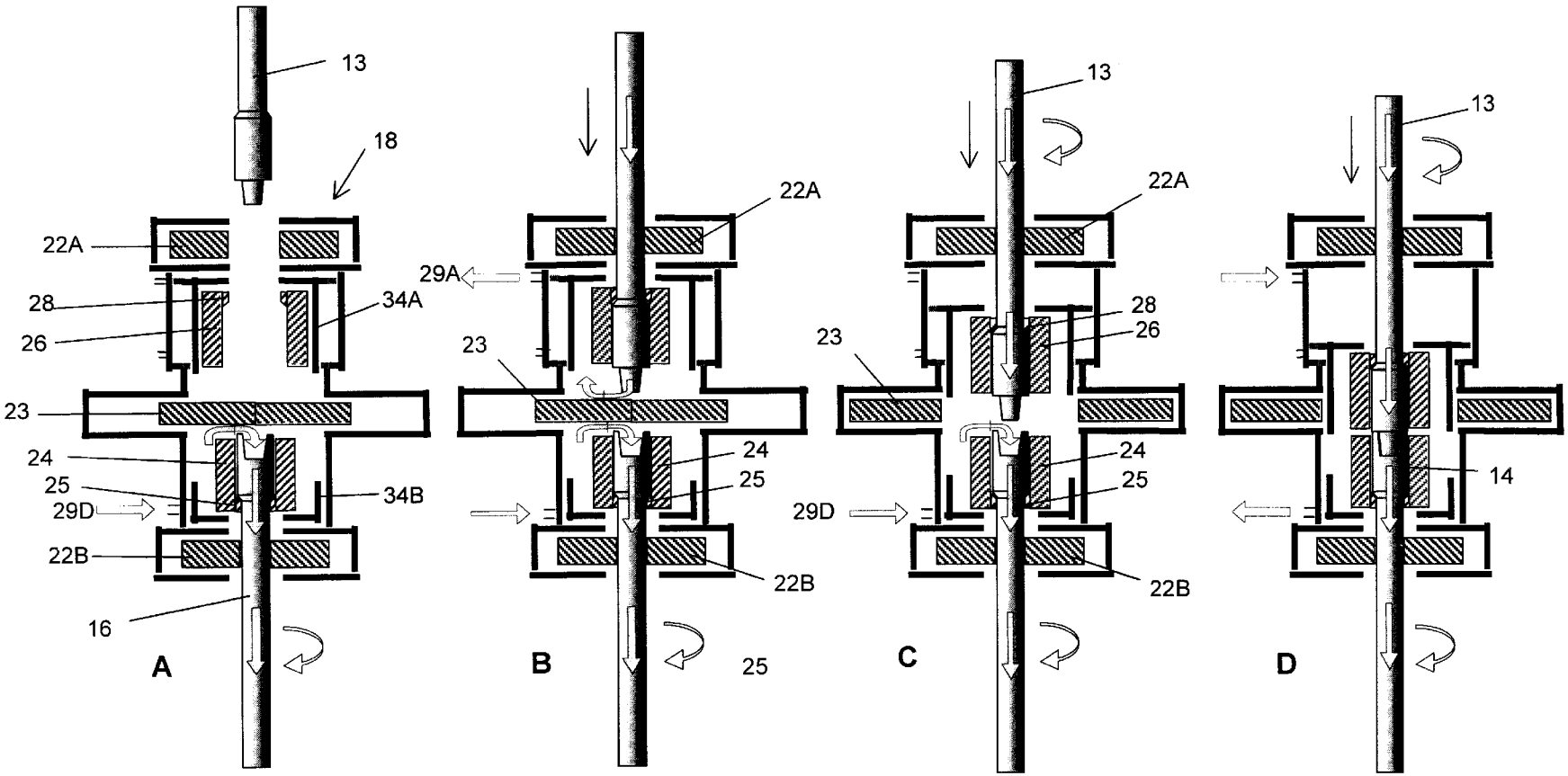
FIGS. 8A–8H are schematic elevational views, in cross-section, showing the operational method of the FIG. 7 embodiment.
Figure 8:
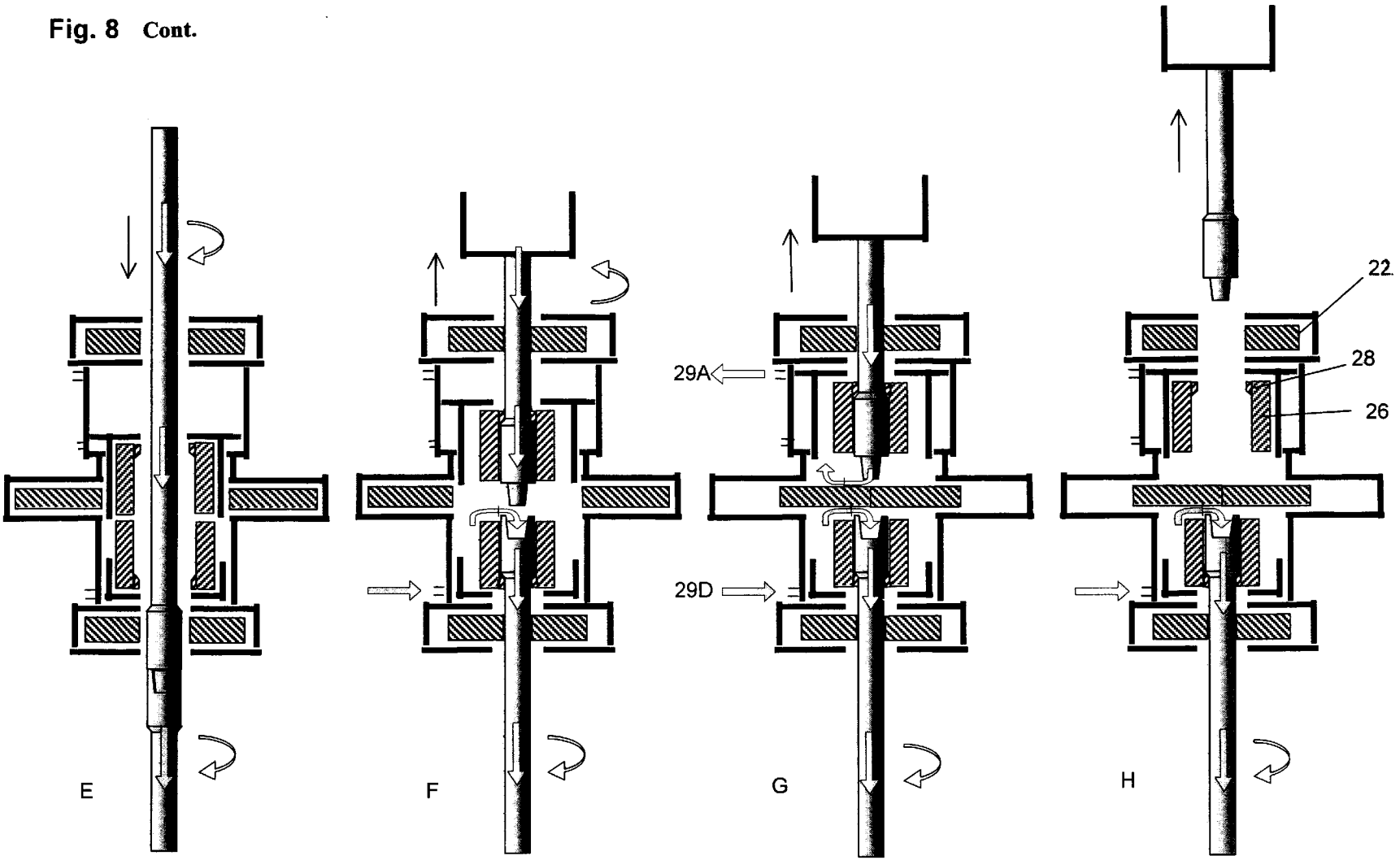

FIGS. 8A–8H illustrate the detailed steps of the method of this embodiment to connect a new tubular. In FIG. 8A, a new tubular 13 is to be added to string 16. The top of the string is gripped by the lower grips and slips, and valve 23 is closed. Upper grips and slips and upper seal 22A are open, and lower seal 22B is closed. At this time, pressurized drilling fluid is supplied through inlet 29D and flows down the drill string so as to continue the circulation of fluid in the bore hole. Also, the lower grips may continue to be rotated, by a drive motor such as M2 shown in FIG. 3A and rotate the drill string so that the drilling operation may also be continuous if desired.

In FIG. 8B the tubular has been lowered by the top drive into the upper chamber of the coupler and is gripped by upper grips. Upper seal 22A is closed, as is valve 23, so that pressurized drilling fluid may be passed down the tubular from the top drive and out of the coupler through outlet 29A. The lower grips and slips may continue to rotate the drill string if desired, and drilling fluid continues to be supplied to the bore hole through inlet 29D and through the lower chamber and downwardly through the drill string. Valve 23 remains closed at this time so as to separate the upper and lower chambers of the coupler.

In FIG. 8C, upper and lower seals 22A–B remain closed while valve 23 has been opened so as to be able to lower tubular 13 and the upper grips and slips below the level of valve 23 and into engagement with upper end of the drill string. During this time, the lower grips 24 may continue to rotate the drill string, and pressurized drilling fluid continues to be supplied through both the tubular and inlet 29D. In FIG. 8D, new tubular 13 has moved down into threaded engagement with box 14 of the uppermost tubular of the drill string. This threaded engagement may be made by the upper grips and slips rotating tubular 13 at a differential speed in the same direction as the drill string. Alternatively, as in the FIG. 1 embodiment, the new tubular may be rotated by the top drive. In either case, the joint is made and torqued so that the new tubular becomes the uppermost tubular of the drill string. As in the previously described steps, circulation of drilling fluid continues through new tubular 13 into the drill string and into the bore hole. In addition, the drill string may continue to be rotated at all times by the lower grips and slips if continuous drilling is desired. Thus, continuous circulation of the drilling fluid to the bore hole is achieved, as can continuous string rotation an drilling, while each new tubular is added.

FIG. 8E shows that, having connected the new tubular, the mud within the coupler may be drained out via 29D and all of the seals and grips and slips retracted. The top drive continues drilling; or simply lowering the drill string when tripping into the well.

FIG. 8F shows that, when the drill string has lowered sufficiently to need the addition of a new tubular, the saver sub of the top drive has reached the region of the lower grips, at which point the seals and grips and slips are all re-applied, the coupler refilled with mud and the saver sub is disconnected from the drill string as shown.

FIG. 8G shows the valve 23 closed to isolate the upper chamber from the lower chamber and also shows that the mud circulation continues into the drill string via inlet 29D and the mud can be drained from the saver sub and upper chamber via outlet 29A.

FIG. 8H shows that the upper seal 22A and upper grips and slips 26 and 28 can be retracted and allow the top drive and saver sub to rise up and accept a new tubular.

Figure 9:
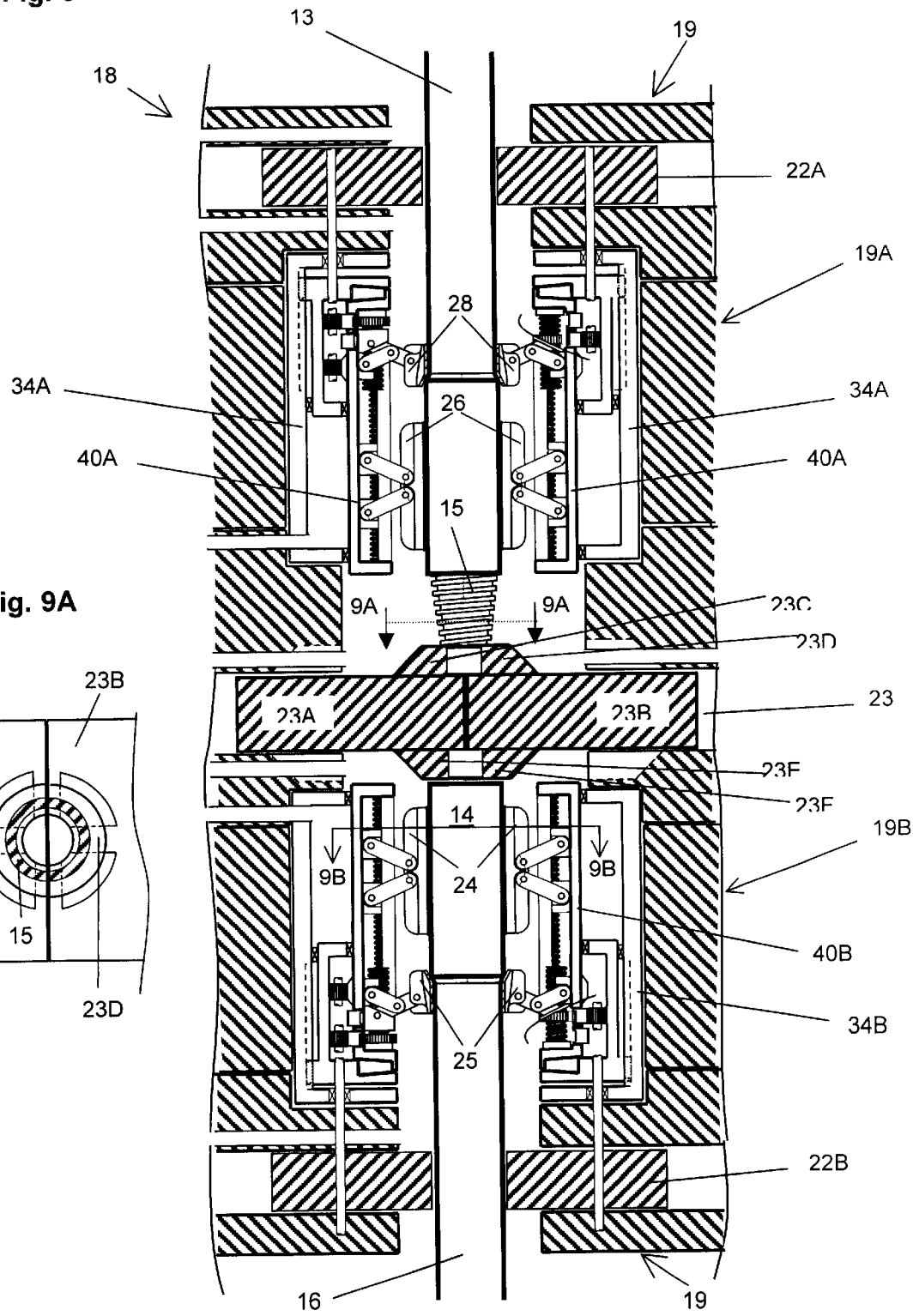
FIG. 9 is a side elevational view, partly in cross-section, showing one embodiment of the present invention in greater detail.
Figure 9A:
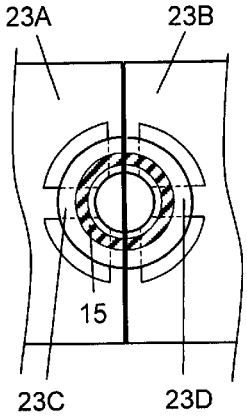
FIG. 9A is a cross-sectional view taken along view line 9A—9A of FIG. 9.

Referring to the simplified assembly drawing comprising FIG. 9, the elements previously described are illustrated with the same numerals as in the prior FIGS. Coupler 18 comprises a high pressure casing 19 with tubular 13 positioned above drill string 16 and ready to be connected to the top of the string. At this time, valve 23 is closed, and box 14 is immediately below the center line of the valve. Valve portions 23A and 23B carry resilient bumpers 23C, D to be more fully described hereafter. High pressure seal 22A is closed and sealed against tubular 13, and lower high pressure seal 22B is closed and sealed about string 16. It will also be noted that upper grips 26 and upper slips 28 are in engagement with tubular 13, and that lower grips 24 and lower slips 25 engage drill string 16. In this embodiment, both the upper and lower slips and grips are positioned within high pressure casing 19. However, it will be understood that these may be positioned above and below casing 19 as will be described hereinafter. As further illustrated in FIG. 9, the sub-assembly of the upper grips and slips is contained within a cage 34A, and the complete assembly of the lower grips and slips is contained within a cage 34B. Upper cage 34A is mounted stationary between upper and lower casing portions 19A, and lower cage 34B is mounted stationary between upper and lower casing portions 19A. The bumpers may be composed of any firm but slightly resilient material which can withstand the pressures and drilling fluids such as, for example, hard rubber. Bumpers 23C and D may be of various shapes and are shown, for example, as segments which extend a few inches horizontally from the center line of the valve, and extend upwardly and downwardly a few inches from valve plates 23A and B with open passages between the segments. Thus, the bumpers not only provide a centering and cushioning effect on the tubular and on the string, but also, they continuously allow drilling fluids to pass through the bumpers. That is, they permit continuous flow of fluids from the tubular into the upper chamber, and from the lower chamber into the string, as will be more fully described in detail hereafter.

Figure 9B:
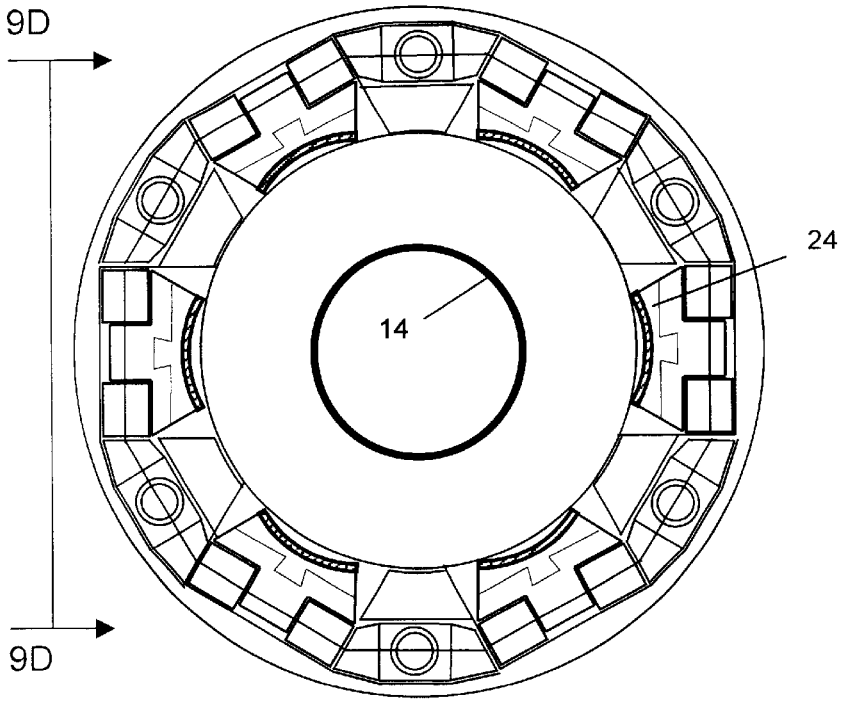
FIG. 9B is a cross-sectional view taken along view line 9B—9B of FIG. 9.
Figure 9C:
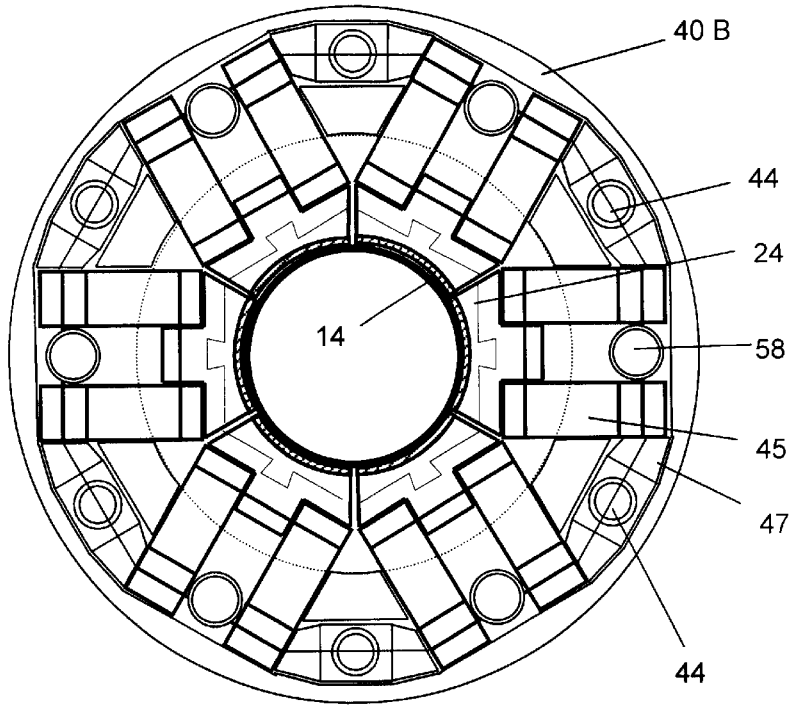
FIG. 9C is the same cross-sectional view with the grips extended.
Figure 9D:
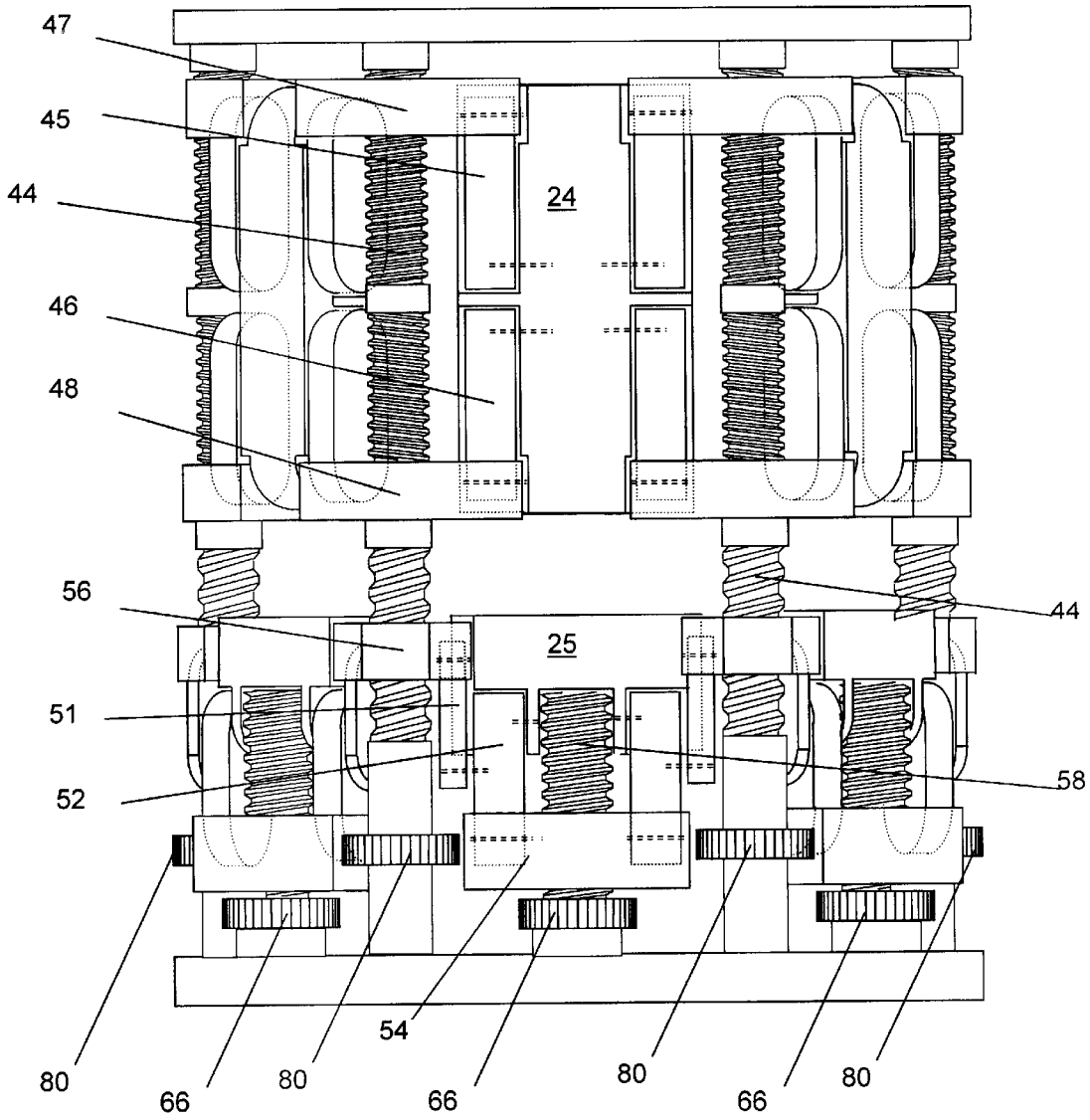
FIG. 9D is an elevational plan view taken along view line 9D—9D of FIG. 9B with the outer casing removed for clarity.
Figure 10:
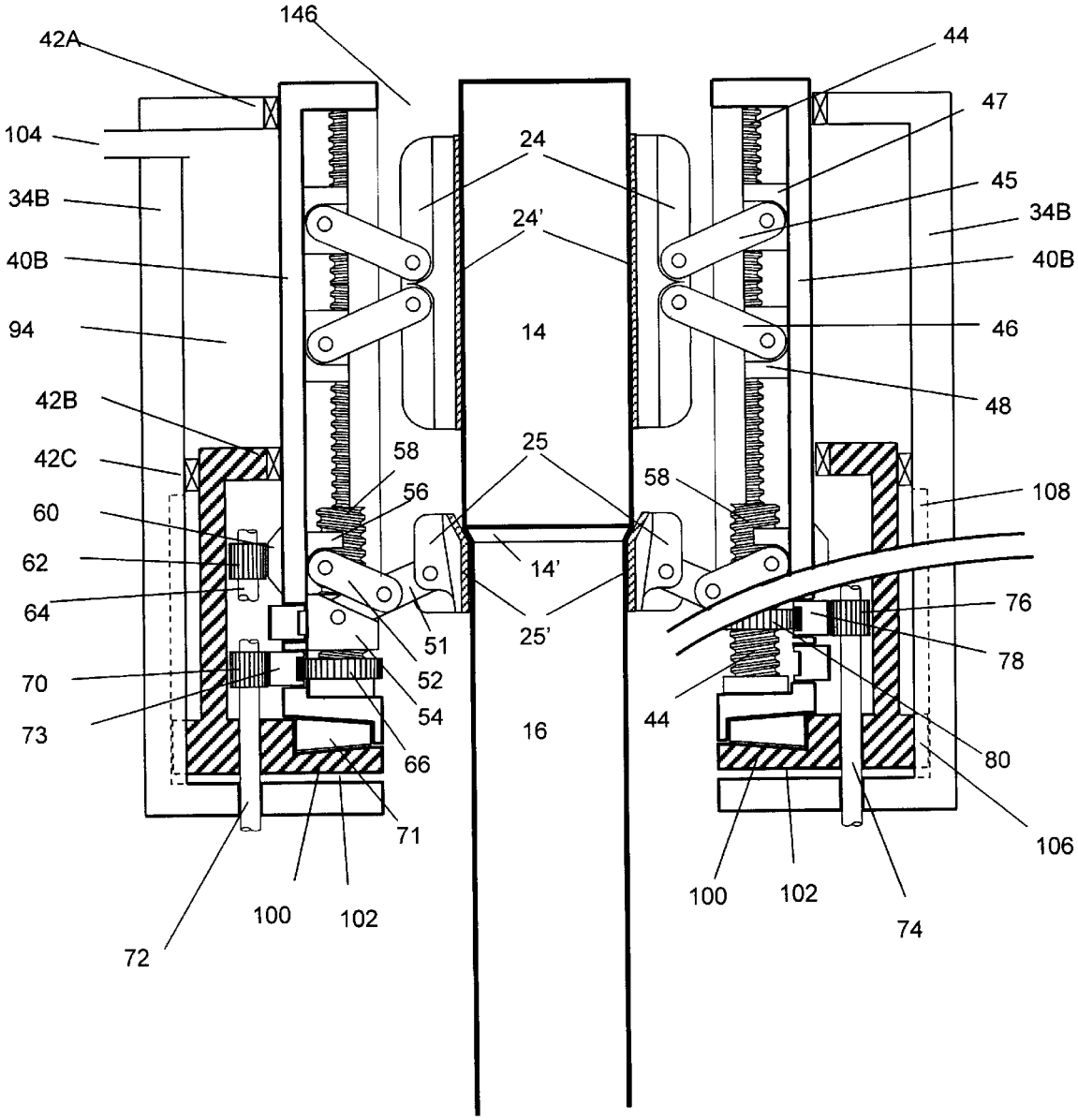
FIG. 10 is an enlarged view of the lower portion of FIG. 9.

Referring to FIGS. 9, 9B–D and 10, lower cage 34B containing the sub-assembly of lower slips and grips is illustrated most clearly. A carrier 40B is mounted for rotational movement within cage 34B, and also for axial movement if desired. Annular seals 42A, B and C are preferably provided between the carrier and the cage as shown most clearly in FIG. 10. Carrier 40B includes a plurality of vertically extending threaded drive screws 44 which are positioned circumferentially about the carriage. As shown most clearly in FIGS. 9, 9D and 10, lower grips 24 are supported and moved radially inwardly and outwardly by pairs of links 45 and 46. One end of each of these links is pivotally connected to the grip, and the other end of each link is pivotally connected to a threaded follower 47, 48. Followers 47, 48 move vertically when drive screws 44 are rotated. In this regard, it will be understood that the upper and lower portions of the drive screws are threaded in opposite directions. Thus, followers 47 and 48 move vertically apart when the drive screw is rotated in one direction, and they move vertically toward each other when the drive screw is rotated in the reverse direction. Followers 47 and 48 are shown in FIG. 10 as having moved to the position closest to each other. In this position, links 45, 46 are in their most radially inward position such that grips 24, and their friction and/or wear pads 24', have been forced radially inwardly into their clamping position about box 14. Conversely, when drive screws 44 are rotated in the opposite direction, followers 47, 48 are moved vertically away from each other such that the radial length of the links is shortened and the grips move radially outwardly to their retracted and non-engagement position.

In FIG. 10, lower slips 25 are shown in their radially inwardly extended position in engagement with string 16 and the lower chamfered or conical surface 14' of box 14. In this position, a positive lock is made at the bottom of the box such that the extreme weight of the string cannot pull the string downwardly, even if grips 24 are retracted or are not capable of supporting the weight by frictional engagement. Preferably, slips 25 include friction or wear liners 25'. Each slip is connected to and moved radially inwardly and outwardly by a pair of links 51, 52. The radially inner end of each thrust link 51 is pivotally connected to a slip 25 and the opposite end of each link 51 is pivotally connected to a threaded follower 54 which is carried on a drive screw 58. At the same time, the mid-portion of each of thrust links 51 is pivotally connected to an actuator link 52, and the opposite end of each link 52 is pivotally connected to a follower 56. Followers 56 are carried by drive screws 44, which also drive followers 47, 48. Preferably, four to eight drive screws 44 are positioned circumferentially around the string as shown in FIGS. 9B, 9C and 11. As drive screws 44 are rotated in one direction, by means to be described hereafter, followers 56 are moved upwardly. As the followers move upwardly, links 52 pull the upper portions of links 51 and slips 25 radially outwardly and out of engagement with string 16 and box 14. Conversely, rotation of drive screws 44 in the reverse direction drives followers 56 downwardly and links 51 and 52 force slips 25 inwardly so as to positively lock string 16 against any downward movement regardless of the position of grips 24.

It will also be understood that, once slips 25 engage string 16 and the chamfered surface 14' of box 14, continued rotation of drive screws 58 will cause followers 54 to move further upward while slips 25 are locked against the chamfered edge of the box. This provides for accommodating different vertical sizes of boxes in common use. It will also be understood that continued upward movement of followers 54 must be accommodated by making the upper portions of drive screws 44 and/or the threads on followers 56 to be a slip-thread or otherwise flexible connection. That is, the threads on screws 44 and followers 56 may be of such dimensions, or of such materials, such as resilient materials, such that followers 56 move upwardly on screws 44 under relatively light load or pressure, as previously described, but under the substantially greater load and pressure of the heavy drill string, the threads of followers 56 may slip over the threads of drive screws 44 without further clamping the already clamped slips 25.

In order to rotate string 16, if continued rotation of the string is desired while tubulars are added, or removed, carrier 40B is surrounded by and connected to an annular gear 60. Gear 60 is in engagement with driving gear 62 carried by shaft 64. Thus, when shaft 64 is rotated, by drive means to be described, carrier 40B is rotated about the vertical axis of string 16. Rotation of carrier 40B causes slips 25, and particularly grips 24, to rotate about the vertical axis, and this rotation causes string 16 to be rotated even though it may be a mile or more in length in the bore hole.

The drive assemblies for rotating drive screws 44 and 58 will now be described with reference to FIGS. 9D and 10. Drive screws 44, which actuate the grips and the slips, are connected at their lower ends to gears 80. A ring gear 78 is provided which has teeth on its inner annular surface which engage drive gear 80. The ring gear also has teeth on its outer annular surface which engage drive gear 76 driven by shaft 74.

The drive assembly for rotating drive screws 58 to raise and lower slips 25 is essentially similar, and it comprises a drive shaft 72 which rotates drive gear 70. Drive gear 70 engages the outer annular teeth of a ring gear 73 while the inner annular teeth of the ring gear engage gear 66 connected to rotate drive screws 58.

It will be readily understood that each of the vertically extending drive shafts such as 64, 72 and 74 are driven by conventional reversible motors, not shown, which may be of either the known electric or hydraulic types. It will also be understood that each of these drive shafts are designed such as to be able to be vertically elongated or shortened as carriers 40A and B are moved vertically within cages 34A and B as will be further described. For example, the drive shafts may be of the splined or telescoping type as is known in the art of conventional drive shafts. Also, while only lower cage 34B and carrier 40B have been described in detail, it is apparent from FIG. 9 that the same structural elements are provided with respect to upper cage 34A and carrier 40A.

In addition to the rotational movement of carrier 40B by ring gear 60 and drive gears 62 and 64 as described, carriage 40B may also be moved vertically so as to raise and lower drill string 16. That is, as shown most clearly in FIG. 9, there is a first vertical distance between the bottom of pin 15 and the top of box 14, and also a second distance for the pin to thread into the box in order to make the threaded connection. Accordingly, carrier 40A must be able to move downwardly by such distance, or carrier 40B must be able to move upwardly by such distance, or each carrier must move one-half of the required distance. The present invention provides the capability to perform each of these modes as will now be described with reference to FIGS. 11, 11A and 11B.

Referring first to FIG. 11, in addition to drive shafts 64, 72 and 74, one preferred embodiment of the present invention further provides additional vertical screws 90 for vertically moving carriers 40A and 40B upwardly and downwardly. For purposes of simplicity, the following description will be with respect to carrier 40B; however, it will be understood that carrier 40A may be moved vertically in the same manner. Screws 90 are positioned circumferentially apart as shown in FIG. 11 so as to not interfere with the previously described drive shafts 64, 72 and 74, or with seals 22A and B. Upon rotation of screws 90 in one direction, by conventional motors, casing or piston 100 moves carriage 40B upwardly or downwardly as desired for the functions or steps hereinafter described. Alternatively, casing or piston 100 may be controlled as to its vertical position by hydraulic means as shown in the break-away view of FIG. 11B. That is, the bottom surface 102 of casing element 100 may be designed to be a piston, with suitable piston rings as desired. Thus, the high well pressure may act, through the mud or other drilling fluid on the lowermost surface 102 of piston 100. Against this pressure, the piston may be controlled by pressurized fluid entering the sealed chamber 94 through passage 104. Therefore, whether operated mechanically or hydraulically, carriers 40A and 40B may be controlled as to their vertical positions, which in turn, controls the vertical positions of string 16 and/or new tubular 13. In both cases it will be understood that a key 106 and keyway 108 as shown in FIG. 10, or other anti-rotational element is provided in order to prevent the carriers from rotating relative to cages 34A and 34B.

FIG. 12 illustrates the relative positions of the elements when a new tubular is to be added to the string. At this time the string is gripped by lower grips 24 and is positively locked against downward movement by slips 25. Lower high pressure seal 22B is closed about string 16, and valve 23 is closed thereby separating the coupler into upper and lower chambers as previously described. Upper high pressure seal 22A is open, and upper grips 26 and slips 28 are in their retracted position thereby enabling a new tubular to be lowered into the upper chamber of the coupler. Also, it will be noted that carriers 40A and 40B are in their uppermost and lowermost positions, respectively.

In FIG. 13, a new tubular has been lowered into the upper chamber and has been gripped by upper grips 26 and slips 28. In this position, it will be noted that pin 15 has engaged bumper 23C which sets the correct position of the new tubular without shock or damage to valve 23. It will also be noted that upper seal 22A has closed and is sealed around the new tubular, and that the vertical positions of carriers 40A and 40B are the same as in prior FIG. 12. At this time, drilling mud or other drilling fluid may continue to pass down the tubular into the upper chamber from which it may exit through a passage such as 29A or 29B by virtue of the flow passages in bumper 23C as previously described. In addition, drilling fluid may be admitted into the lower chamber through passage 29C or 29D from which it may exit down the string through the lower bumper of similar construction. Accordingly, it will be apparent that drilling fluid may be circulated continuously through the upper and lower chambers of the coupler, and down the string into the bore hole while new tubulars are added to the string, or removed therefrom. In addition, it will be understood that if it is desired to continue drilling during the addition of tubulars, carrier 40B may continue to be rotated such as through ring gear 60 and drive gear 62 as previously described. At this time the upper end of the string remains secured in a fixed vertical position, but drilling may continue due to elongation; i.e., stretching of the string, or by use of a bumper sub or similar extension, such that the bit continues to drill downwardly if continuous drilling is desired.

FIG. 14 illustrates the elements in the same positions as in FIG. 13, but also illustrates valve 23 as having been opened. Opening of valve 23 allows carrier 40A to pass downwardly and carrier 40B to move upwardly. Also, the upper and lower chambers are in open communication such that the string may receive continuing flow of drilling fluid from both the new tubular and from that supplied to the coupler such as through passages 29A and/or B and/or 29C and D.

FIG. 15 illustrates the position of the elements after carrier 40A has moved downwardly, and carrier 40B has moved upwardly, to make the connection of the new tubular to the string. That is, for example, by rotating the new tubular by the upper grips, or by the top drive, while bringing the tubular down and the string upwardly by the respective vertical movements of carriers 40A and 40B. In this regard it will be understood that the string may be held stationary by the lower grips while only the tubular is rotated by the upper grips in order to screw the pin into the box. Alternatively, if the string is being rotated by lower grips 24 for down hole operational reasons or in order to continuously drill, the tubular may be rotated in the same direction but at a higher RPM. In either event, the connection is properly torqued and fluid flow to the coupler may be terminated since the flow of drilling fluids down the new tubular to the string is fully sufficient to continue continuous drilling circulation of drilling fluid, and drilling if desired. Thereafter, all of the slips and grips are retracted as shown in FIG. 16 and the drilling continues for the length of the new tubular until the next new tubular is added in the same manner. If the coupler is not mounted on or integral with the BOP stack, the drilling fluid in the coupler is flushed out and drained through passage 29D before lower seal 22B is opened. Conversely, it will be apparent that the above-described steps may be performed in the reverse order when it is desired to remove tubulars.

From the foregoing description of one preferred mode of operation, it will be apparent that upper carrier 40A may be held vertically stationary while string 16 is raised the required distance by upward movement of lower carrier 40B. However, in view of the substantial weight of the string, it is preferred that lower carrier 40B be designed to remain stationary, and that the full distance of the required movement is performed by upper carrier 40A. This embodiment is illustrated in FIGS. 17–19 and it will be apparent from FIG. 17 that piston 100 of the lower assembly may be eliminated thereby simplifying the overall design. As illustrated in FIG. 18, upper carrier 40A and keyway 106 are designed to be sufficiently long such that carrier 40A may move downwardly by the full distance required to make the connection. This is further illustrated in the assembly drawing of FIG. 19. In this illustration it will be apparent that the distance to be traveled downwardly by the new tubular is more than sufficiently provided for by the downward vertical movement of carrier 40A within cage 34A.

Figure 20:
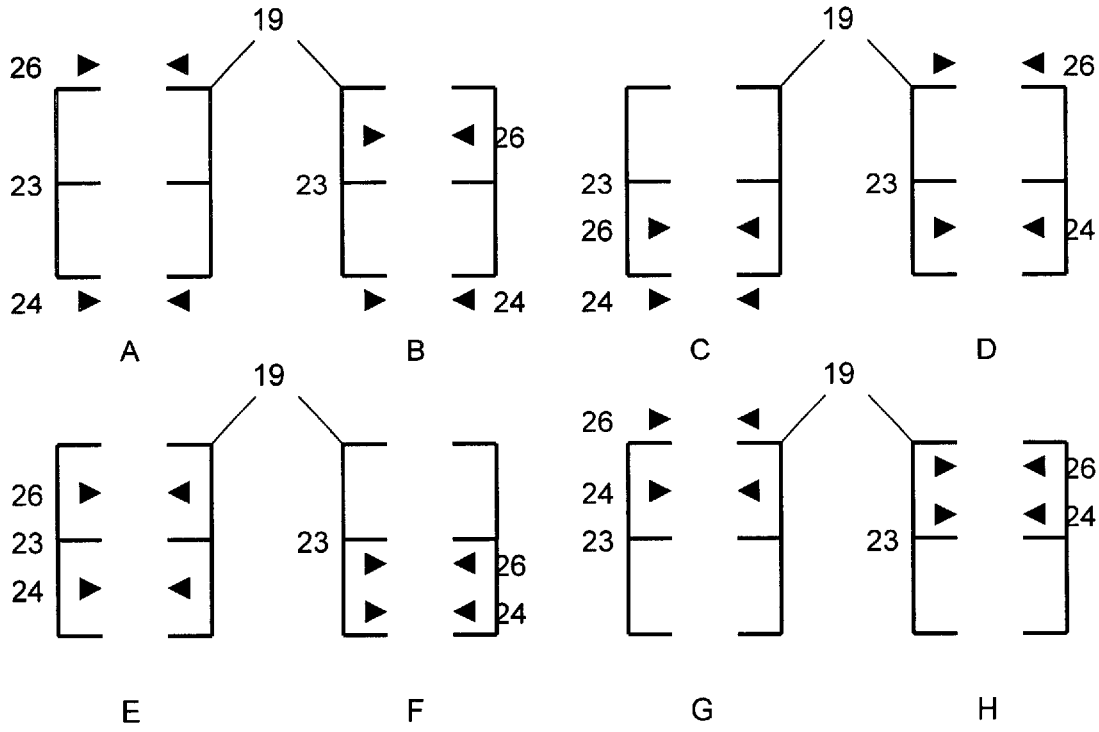
FIGS. 20, 20A and 20B schematically illustrate the different positions in which the grips and slips may be located in the present invention.
Figure 20A:
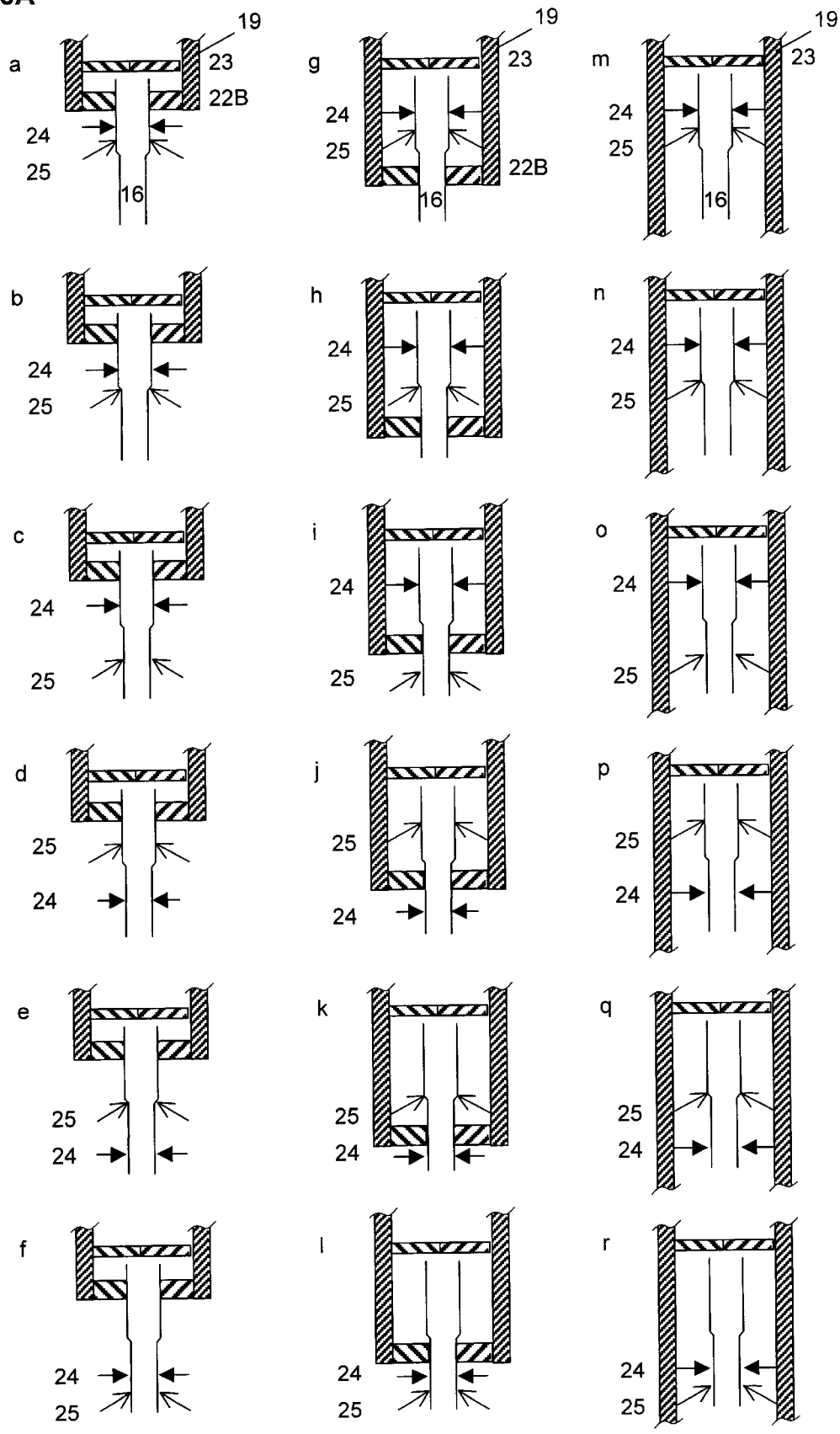
Figure 20B:
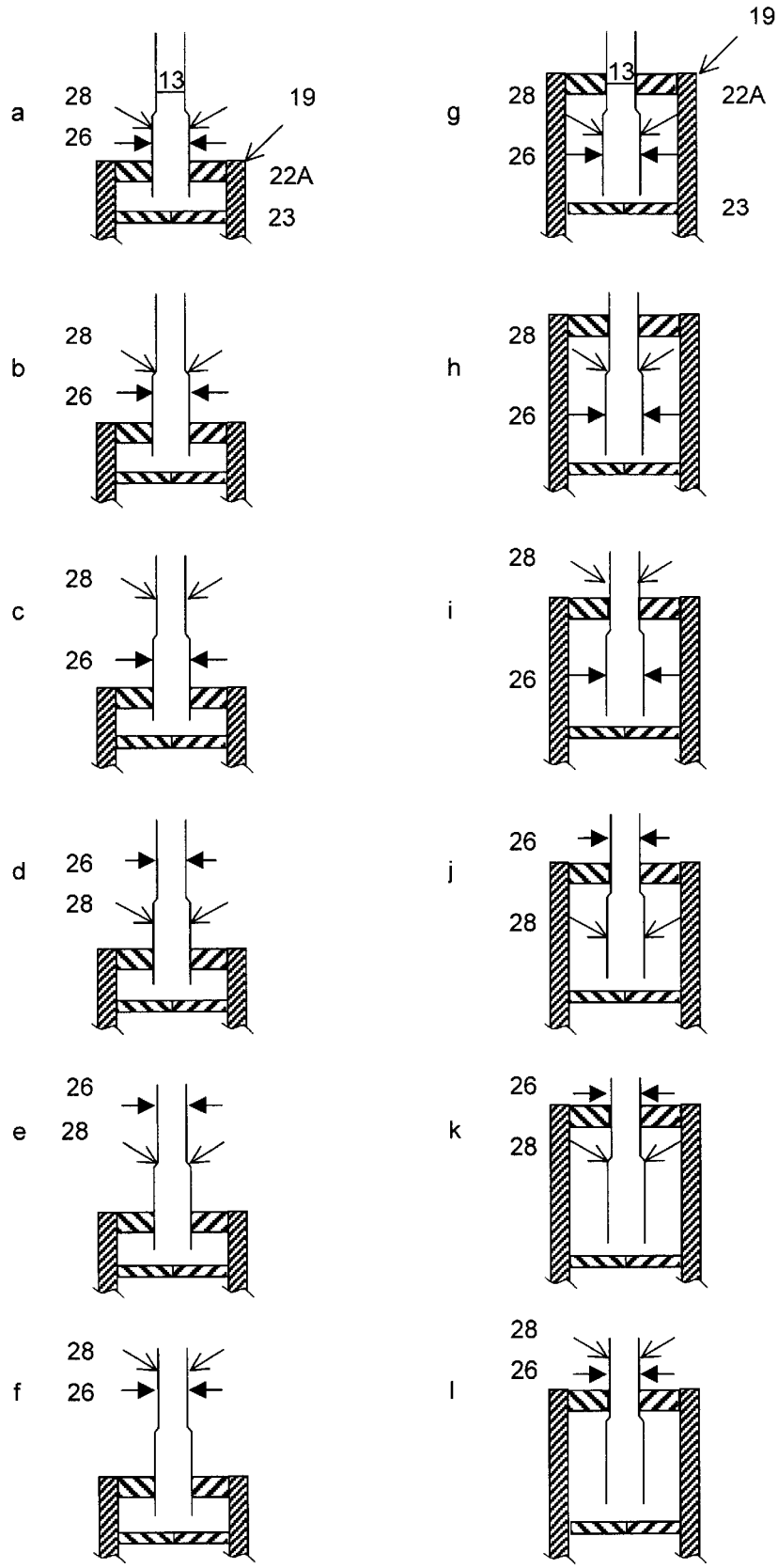

With regard to the locations of the grips and slips relative to casing 19 and valve 23, FIG. 20 schematically illustrates eight relative locations which are possible with the present invention. For example, FIG. 20A illustrates both the upper grips 26 and the lower grips 24 as being outside of casing 19. FIG. 20B illustrates upper grips 26 as being in the casing above valve 23, and the lower grips outside and below the casing. FIG. 20C illustrates the upper grips as being in the lower chamber while the lower grips 24 are outside and below the chamber. In FIG. 20D, the upper grips are illustrated above the casing with the lower grips in the lower chamber of the casing. FIG. 20E illustrates the embodiment shown in FIG. 9, as previously described, in which upper grips 26 are within the casing and above the valve, and lower grips 24 are in the lower chamber of the casing and below the valve. FIG. 20F illustrates the positions of the grips as previously described with respect to the FIG. 2 embodiment in which both of the upper and lower grips are within the casing and below the valve. In FIG. 20G, the upper grips are outside and above the casing while the lower grips are in the upper chamber of the casing. Lastly, FIG. 20H illustrates the embodiment in which both of upper grips 26 and lower grips 24 are in the upper chamber of the casing above valve 23.

In addition to the above, it has discovered that, for use in the present invention, certain positions and combinations of slips, grips and seals are substantially preferred and lead to unexpected advantages and results. For example, FIG. 20A illustrates the multiple positions which are possible, at least theoretically, for the positions of the seal and lower slips relative to each other and relative to chamber 19. Similarly, FIG. 20B illustrates the theoretically possible locations of the seal and upper slips and grips relative to each other and to chamber 19. While all of these locations are physically possible, some locations produce unexpectedly superior results. For example, the surfaces of the upsets are usually much rougher than that of the tubular body. Therefore, the lower seal 22B would wear out unless it is more expensive RBOP. Therefore, embodiments g to l in FIG. 20A are preferred for substantially longer and more effective seal life without resorting to rotating seals. At the same time, it has been noted that the grips should engage the upset, and not the tubular body, in order to prevent potentially serious damage to the surface of the tubular. Therefore, it has been discovered that the upset of the tubular should be gripped by the grips such as illustrated in FIGS. 20A a, b, c, g, h, i, m, n and o.

The theoretical options for the upper seals and upper slips and grips are also illustrated in FIG. 20B. However, the principles described with reference to FIG. 20A also apply. Thus, the embodiments of FIGS. 20B b and h have been discovered to produce the most unexpected results in combination with the other elements of the present invention. As a result, it has been discovered that the preferred positioning of the seals, grips and slips, including the serious factor of minimizing the vertical height of the coupler which also is very important for achieving the optimum results of the present invention, is to position the elements as illustrated in FIGS. 20A h and 20B h if the slips and/or grips are located within the pressure casing 19. In the future, as the industry modifies its present equipment, the optimum results have been discovered to be with 20B h above and 20A n below.

Figure 21:
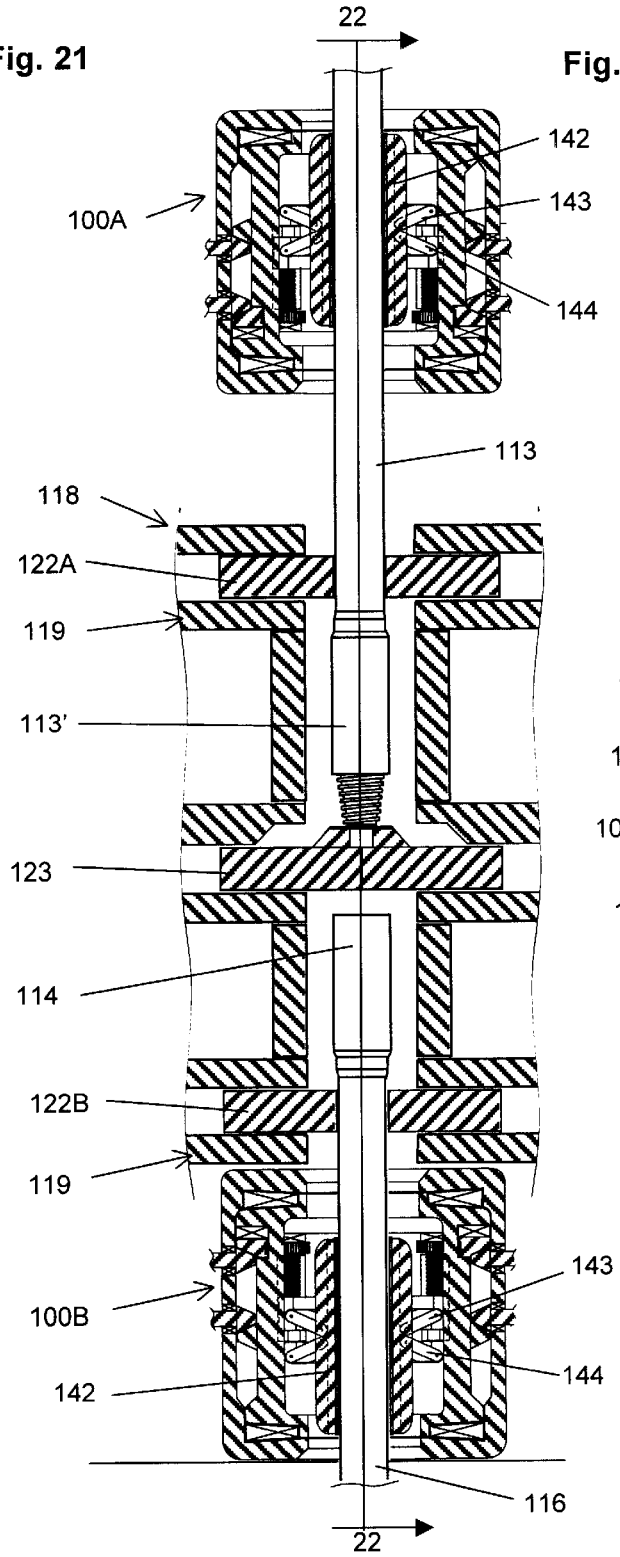
FIGS. 21–27 are elevational views, partly in cross-section, illustrating another embodiment of the present invention in which the grips are positioned outside of the coupler.
Figure 22:
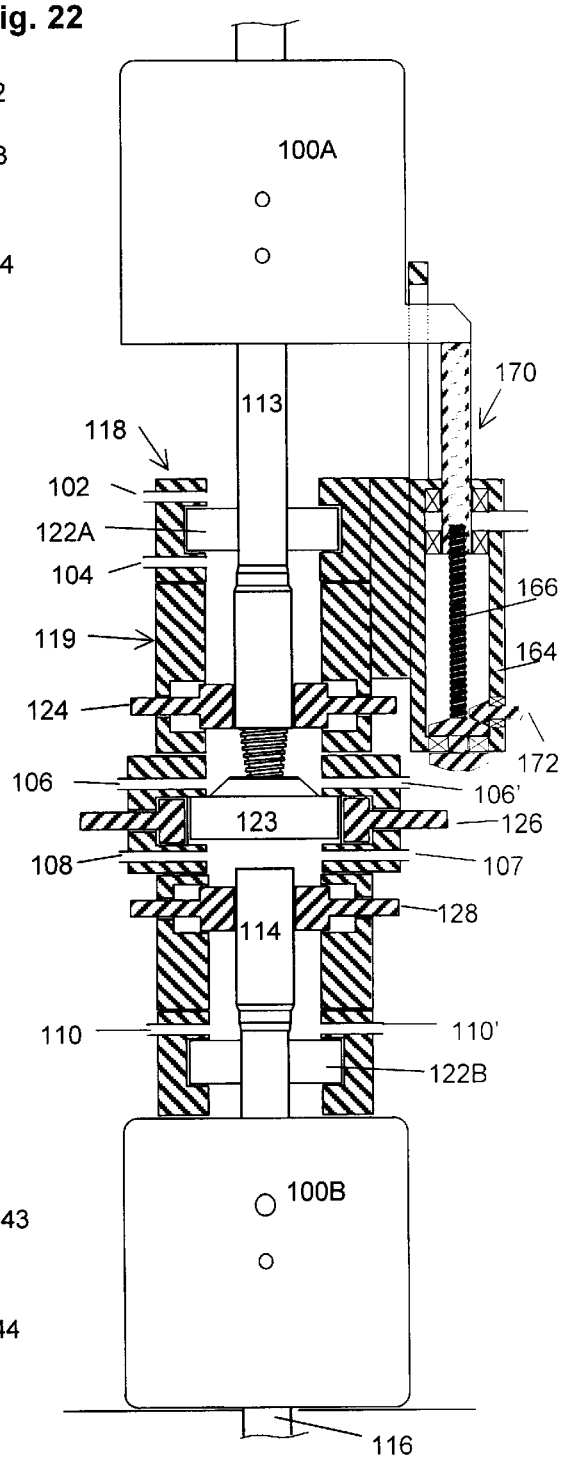

As previously stated, the advantages of the present invention may also be accomplished by positioning the grips, and slips if desired, outside of pressure casing 19. This embodiment is illustrated schematically in FIGS. 21–27. As shown in FIGS. 21–22, in this embodiment the high pressure casing 119 is positioned between the upper grips assembly 100A and the lower grips assembly 100B. Upper grips assembly 100A engages a tubular 113 and lower grips assembly engages a drill string 116. High pressure casing 119 encloses an upper seal 122A, a lower seal 122B, and a valve 123. It will be understood that these elements correspond to previously described elements 19, 22A–B and 23, and that they operate in the same manner as their previously described counterparts. It will be apparent to those skilled in the art that the lubricants and drilling fluids may be supplied to and from casing 119 in various ways similar to that previously described. However, one preferred embodiment is illustrated in FIG. 22 in which lubricant for the upper annular preventer or seal 122A may be supplied through port or passage 102. Passage 104 may be provided for supplying mud and purge air to the upper chamber from which it may be discharged through passages 106. Mud or other drilling fluid may be supplied to the lower chamber through passage 108 so as to flow down the drill string for continuous circulation as previously described, and excess drilling fluid and/or purge air may exit the lower chamber through passages 110. An additional passage 107 is preferably provided for injecting a lubricant or dope in contact with the pin and box when valve 23 is open and the pin has been lowered.

As further shown in FIG. 22, centering elements or rams 124, 126 and 128 are preferably provided. The rams extend at a 90° angle relative to valve 23, and may be moved radially inwardly to engage and center the lower end of tubular 113 and the upper end of drill string 116, by conventional electric or hydraulic motors not shown, as the tubular and string are about to be coupled. Centralizing ram 126 may also be used to centralize pin 115 relative to box 114 when valve 123 is open just prior to the coupling.

Figure 23:
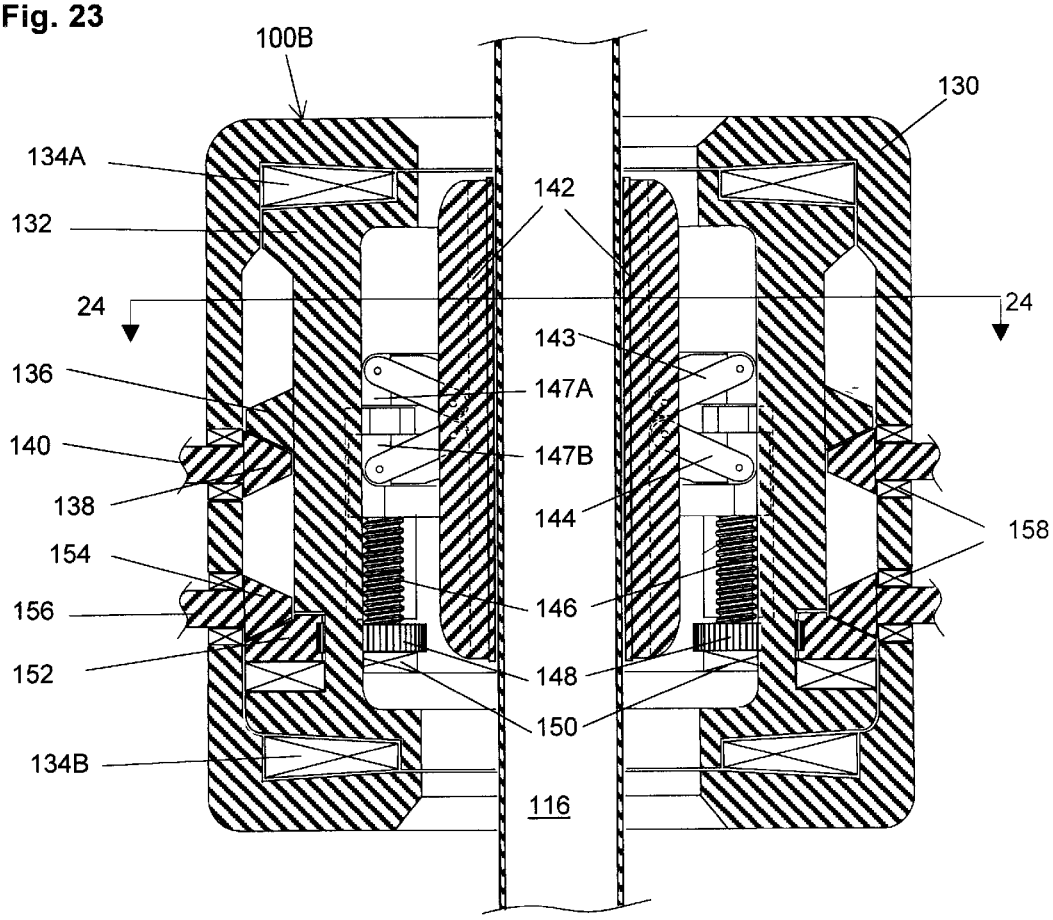
Figure 24:
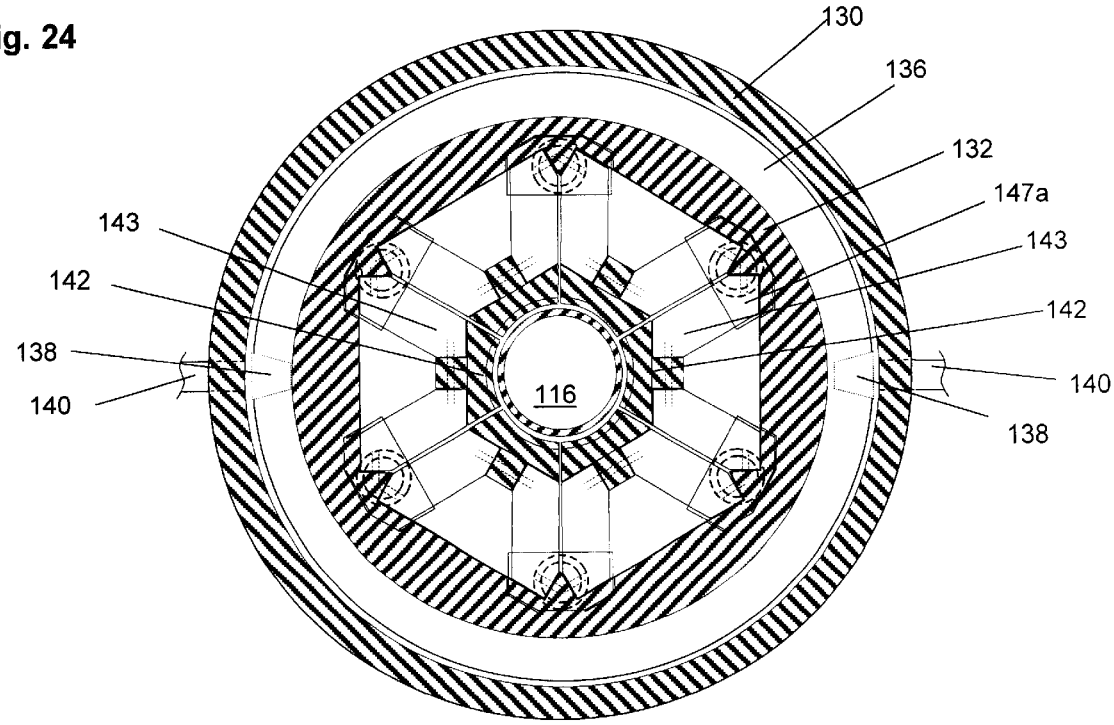

Referring now to FIG. 23, the lower grip assembly 100B is schematically illustrated in one preferred embodiment, and it will be understood that the upper grip assembly may be the same but reversed so as to be upside down. Grip assembly 100B includes an outer casing or shell 130 within which a drum 132 is contained and mounted for rotation between upper and lower thrust bearings 134A and 134B. Drum 132 includes an annular ring gear 136 which may be driven by one or more drive gears 138 rotated by one or more drive shafts 140 which are driven by conventional reversible motor(s) not shown. Thus, drum 132 may be rotated clockwise or counter-clockwise in order to rotate grips 142 about the axis of string 116. Grips 142 are moved radially inwardly and outwardly by sets of links 143 and 144 are which moved vertically by followers 147A and B carried by drive screws 146 in the same manner as previously described. Drive screws 146 are connected to and rotated by drive gears 148 supported by thrust bearings 150. Drive gears 148 are rotated by an annular gear 152 having inner teeth which engage gears 148, and having outer teeth which engage one or more drive gears 154. Drive gears 154 may be driven by conventional motors through shafts 156 extending through high pressure seals 158.

The operation of this embodiment will be readily understood from the prior description in that drive screws 146, having upper and lower reverse threads, move links 143 and 144 inwardly and outwardly depending upon the direction of rotation of drive screws 146 and the direction and speed differential of drive shafts 140 and 156. In addition, it will be understood that grips 142 may also function as slips in that the downward force created by the weight of the string causes lower links 144 to increase the gripping force on the string. That is, the grips and lower links act as wedges which prevent downward axial movement of the string. Similarly, the upper set of links 143' in grip assembly 100A act as wedges forcing grips 142' into tighter engagement with the tubular as the high pressure in the coupler chamber applies a substantial upward force on the tubular before the connection is made with the string. In addition, in the preferred embodiment, the axial length of the grips is made greater than that of the previously described grips. For example, instead of a common length in the order of 6 to 10 inches, grips 142 and 142' are preferably in the order of 18 to 24 inches in axial length.

Figure 25:
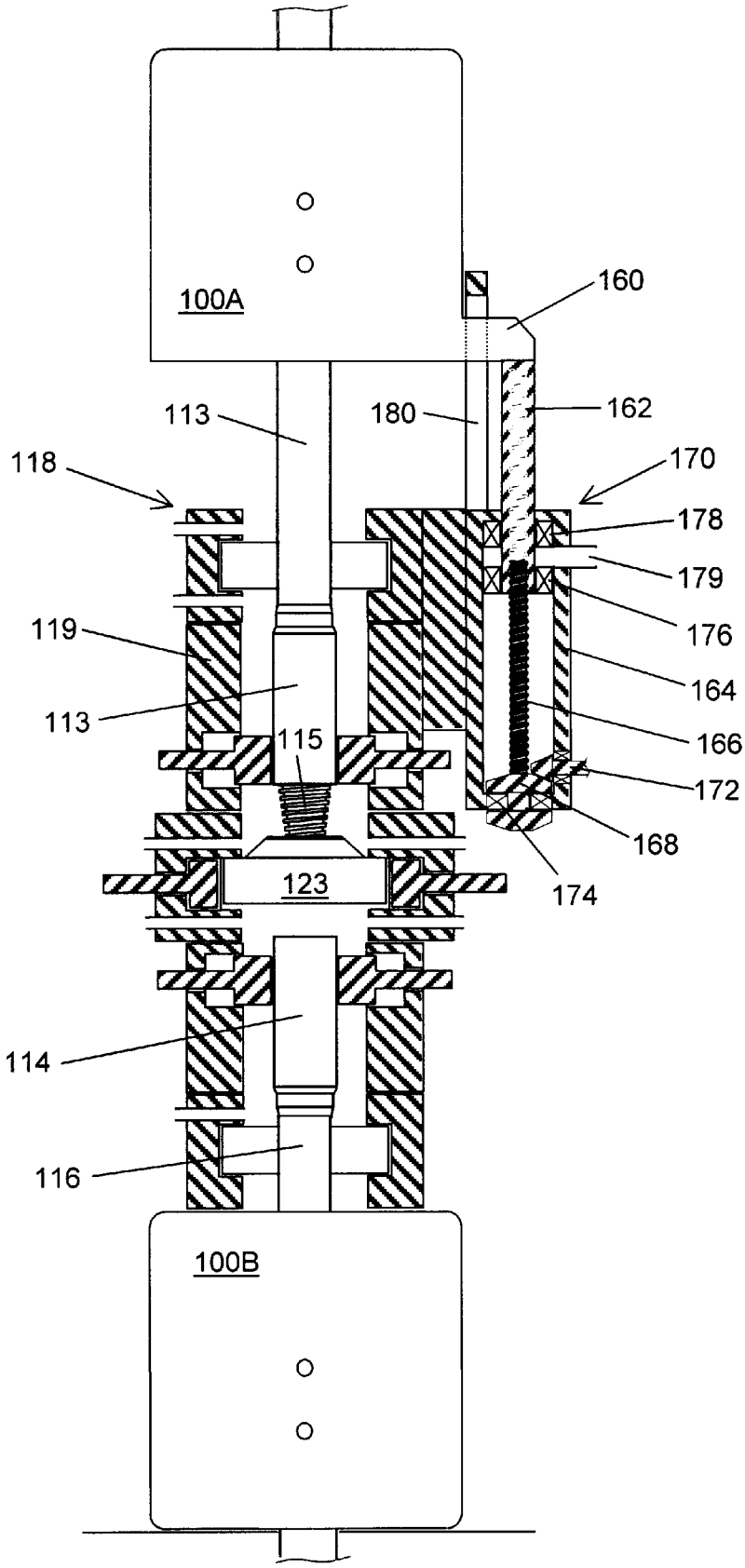

As previously discussed and as illustrated in FIGS. 21, 22 and 25, one or other or both of tubular 113 and string 116 must be moved vertically toward each other for connecting or removing a tubular to or from the string. FIG. 25 illustrates one preferred embodiment in which coupler casing 119 and lower grip assembly 100B may remain stationary while upper grips assembly 100A and tubular 113 are moved the required vertical distance by a power system 170, although it will be apparent that lower grips assembly 100B may be moved on similar manner if desired. In the embodiment as illustrated, upper grips assembly 100A includes an offset casing portion 160 which carries an internally threaded power sleeve 162. Casing 119 of the coupler includes an offset housing 164 which carries a threaded power screw 166. Power screw 166 is connected to and rotated by a gear 168 which is driven by a drive gear and shaft 172. Gear 168 and power screw 166 are provided with a thrust bearing 174 at the lower end. Power sleeve 162 slides through high pressure seal 178 and seals against the inside of casing 164 with high pressure seal 176. Therefore, as power screw 166 is rotated by shaft and gear 172, and gear 168, the power screw moves power sleeve 162 and upper grip assembly 100A downwardly or upwardly as desired to make or break the connection of the tubular. Alternatively, the power gear assembly may be replaced by a hydraulic power assembly. Additionally, hydraulic fluid at a pressure equal to or proportional to the mud pressure in the drill string may be admitted through passage 179 to pressure balance the forces and thereby reduce the force on the threads of the screw. Of course, it is preferred to provide two or more power systems 170 circumferentially spaced about the vertical axis of the grip assembly in order to balance the forces and apply the total force desired. In addition, the preferred embodiment includes a vertically extending stop or guide 180 which extends between the grip assembly 100A and the casing 119 so as to allow the vertical movement just described while acting against any torque forces therebetween.

Figure 26:
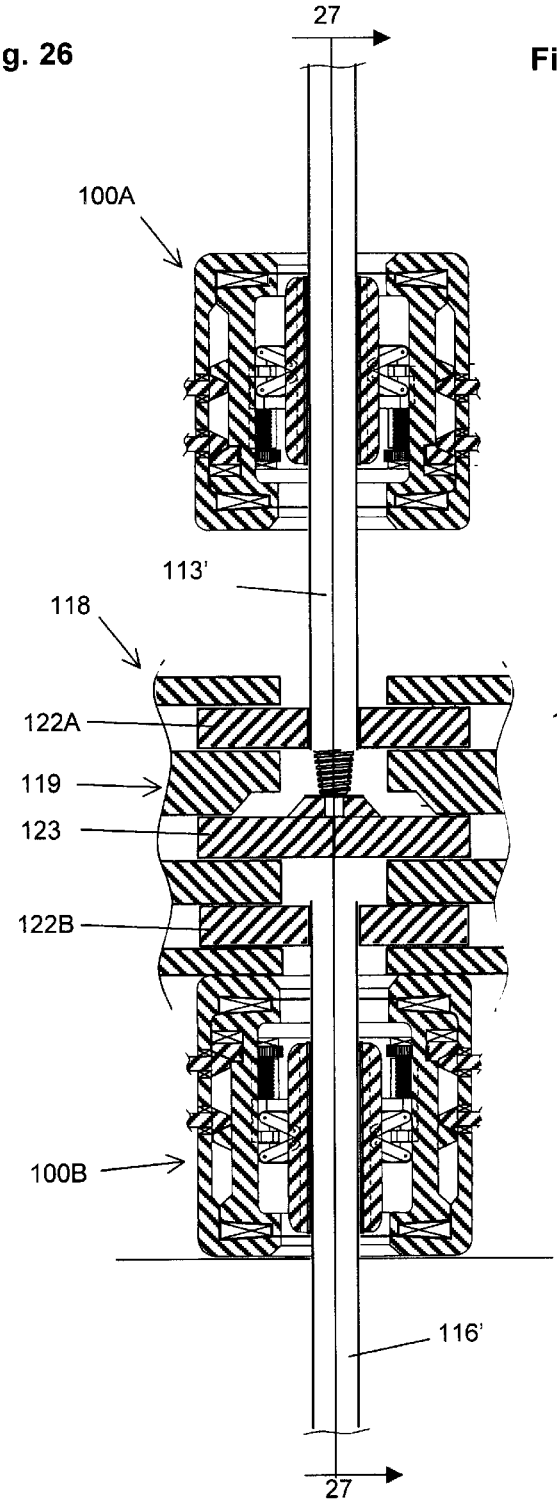
Figure 27:
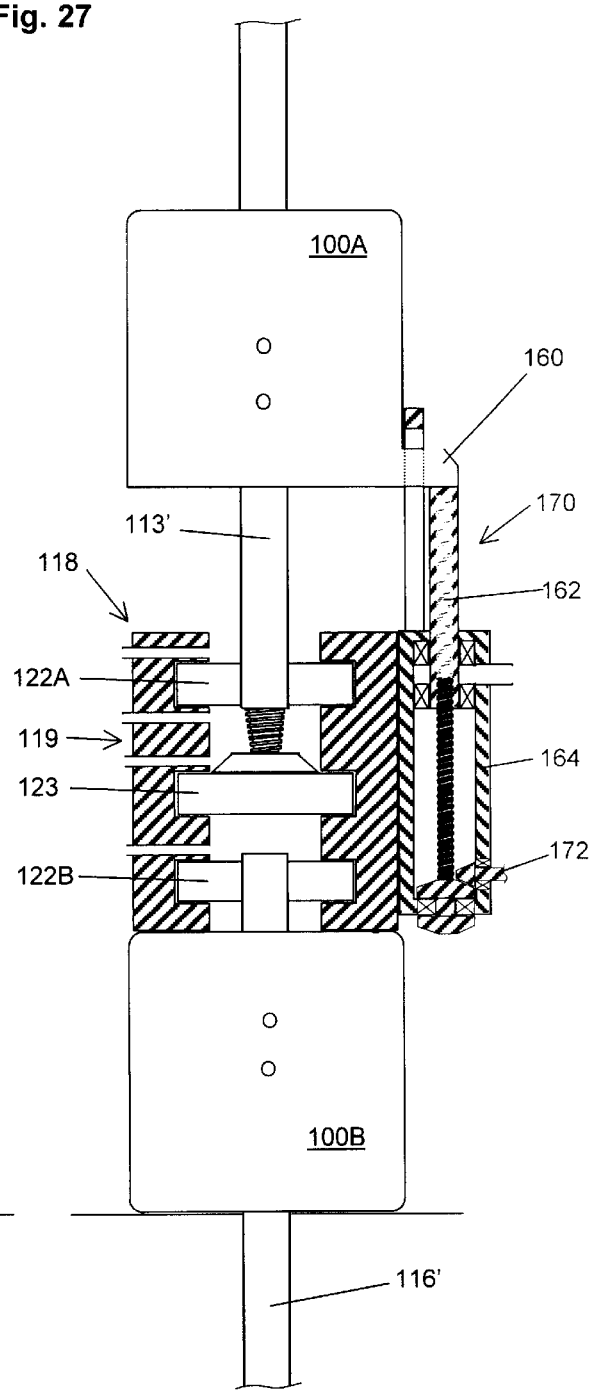

FIGS. 26 and 27 illustrate the application of the external grips to tubulars which do not have external upsets or boxes, and to tubulars having small diameters and relatively thicker walls. Without external upsets, the distance between upper and lower seals 122A and 122B may be greatly reduced. Additionally, the grips may be shortened due to the greater thickness of the tubular wall. As a result, it has been discovered that the vertical height of the overall casing and external grips may be substantially reduced. In this embodiment, the vertical height of coupler casing 119' is reduced such that it may be in the order of the vertical height of the entire power system 170, and the high pressure casing 119 and the lower grips assembly 100B may be one, integrated casing.

From the foregoing brief description of several embodiments of the present invention, it will be apparent that very substantial savings in the cost of drilling may be achieved. It is also to be understood that the present invention may be remote controlled, such as in off-shore under sea drilling operations, by remotely controlling the drive motors by radio or sonar signals. It will also be understood that, instead of the coupler being supported by a rig floor, the coupler may be mounted on handlers for mobile operation so as to perform hand-to-hand or hand-over-hand drilling operations as more fully described in published PCT Applications WO 98/16716 and WO 00/22278 which are hereby incorporated by reference. Of course, it is to be understood that the foregoing description of several preferred embodiments is intended to be purely illustrative of the principles of the invention, rather than exhaustive thereof, and that the present invention is not intended to be limited other than as expressly set forth in the following claims interpreted under the doctrine of equivalents.

What is claimed is:

1. A coupler for continuously circulating a drilling fluid through a drill string while adding or removing tubulars comprising:

(a) a lower fluid pressure seal adapted to engage a drill string;

(b) lower grips adapted to engage a drill string;

(c) a valve positioned above said lower grips;

(d) upper grips adapted to engage a tubular to be added to or removed from said string; and (e) an upper fluid pressure seal adapted to engage said tubular.

2. The coupler of claim 1 in which said valve is a blind preventer.

3. The coupler of claim 1 in which said upper and lower fluid pressure seals comprise BOP's or RBOP's.

4. The coupler of claim 1 including slip means positioned above said valve for positively preventing upward vertical movement of said tubular.

5. The method of adding or removing tubulars to and from a drill string extending into a bore hole and carrying a drill bit comprising:

(a) suspending the weight of the drill string from at least one slip;

(b) providing a first set of grips for frictionally engaging said drill string;

(c) rotating said drill string and said tubular relative to each other and thereby connecting or disconnecting tubulars; and (d) throughout steps (a) to (c) continuously flowing drilling fluid down said string to said drilling bit.

6. The method of claim 5 in which said string includes an uppermost tubular, and said uppermost tubular includes a box, and in which method step (a) includes engaging the lower portion of said box with said slip and positively locking said string against downward movement.

7. The method of claim 5 further including a second set of grips positioned above said first set of grips, and engaging said tubular to be added or removed by said second set of grips.

8. The method of claim 7 including a pressure resistant casing and providing a valve between said first and second sets of grips with said pressure resistant casing.

9. The method of claim 5 in which the step of rotating said string and tubular relative to each other includes the step rotating said string by rotating said first recited grips.

10. The method of claim 5 including the step of providing a second set of slips above said first set of slips in engagement with said tubular.

11. Apparatus for drilling into the earth comprising a coupler for connecting and disconnecting tubulars to and from a drill string while continuously circulating drilling fluid into and out of a bore hole comprising:

(a) a coupler, said coupler including a pressure resistant casing forming a substantially fluid-tight chamber;

(b) an openable and closeable valve in said casing, said valve dividing said chamber into upper and lower chamber portions;

(c) first rotatable grips positioned above said valve;

(d) second rotatable grips positioned below said valve; and (e) first and second seals positioned above and below said valve, respectively.

12. The apparatus of claim 11 wherein at least one of said first and second rotatable grips are positioned within said fluid-tight chamber.

13. The apparatus of claim 11 wherein both of said first and second rotatable grips are positioned within said fluid-tight chamber.

14. The apparatus of claim 11 including drive means for rotating at least one of said first and second rotatable grips relative to the other.

15. The apparatus of claim 14 including additional drive means for vertically moving said first and second rotatable grips relative to each other.

16. The apparatus of claim 11 including vertical movement means for moving said first and second grips toward and away from each other for connecting and disconnecting said tubular to and from said drill string.

17. A coupler for continuous circulation of drilling fluids while connecting or disconnecting a tubular comprising:

(a) lower grip means for engaging a drill string;

(b) upper grip means for engaging a tubular to be added or removed from said drill string; and (c) upper slips for preventing upward vertical movement of said tubular.

18. The coupler of claim 17 including both upper and lower slip means.

19. The coupler of claim 17 including motor means for rotating at least one of said grip means about the vertical axis of said string.

20. A coupler for continuously circulating a drilling fluid through a drill string while adding or removing tubulars comprising:

(a) a casing;

(b) a lower fluid pressure seal connected to said casing and adapted to engage the drill string;

(c) lower grips adapted to engage the drill string;

(d) a valve positioned in said casing above said lower grips;

(e) upper grips adapted to engage a tubular to be added to or removed from said string;

(f) an upper fluid pressure seal connected to said casing and adapted to engage said tubular; and (g) at least one of said upper or lower grips is positioned within said casing.

21. The coupler of claim 20 wherein both of said upper and lower grips are positioned within said casing.

22. The coupler of claim 20 in which said upper and lower fluid pressure seals comprise BOP's or RBOP's.

23. A coupler for continuously circulating a drilling fluid through a drill string while adding or removing tubulars comprising:

(a) a casing;

(b) a lower fluid pressure seal connected to said casing and adapted to engage said drill string;

(c) lower grips adapted to engage said drill string;

(d) a valve positioned in said casing above said lower grips;

(e) upper grips adapted to engage a tubular to be added to or removed from said string;

(f) an upper fluid pressure seal connected to said casing and adapted to engage said tubular; and (g) said upper and lower seals comprising BOP's or RBOP'S.

24. Apparatus for connecting and disconnecting tubulars to and from a drill string while continuously recirculating drilling fluid through the drill string, the apparatus comprising:

(a) a high pressure chamber;

(b) a partition dividing said chamber into upper and lower portions;

(c) said partition including valve means for placing said upper and lower portions in communication when said valve means are open;

(d) high pressure seals positioned adjacent said upper and lower casing portions;

(e) inlets and outlets for continuously recirculating drilling fluid into and out of said chamber;

(f) upper gripping means for gripping said tubulars;

(g) additional lower gripping means for gripping said drill string; and (h) said upper and lower gripping means being radially movable into and out of engagement with said tubulars and said string, respectively, for connecting and disconnecting said tubulars while drilling fluid is continuously circulated into said chamber and down the drill string.

25. Apparatus for connecting and disconnecting a plurality of tubulars having upsets to and from a drill string while continuously circulating drilling fluid down a bore hole comprising;

(a) a pressure resistant chamber having an upper end for receiving a tubular with an upset and a lower end for receiving a drill string;

(b) first fluid pressure sealing means for moving radially and sealing said upper chamber end about said tubular;

(c) second fluid pressure sealing means for moving radially and sealing said lower chamber end about said drill string;

(d) a divider valve in said chamber for dividing said chamber into upper and lower portions and for placing said upper and lower chamber portions into and out of fluid communications with each other; and (e) wherein at least said first fluid pressure sealing means is a radially movable seal of a size and shape such as to not allow passage of said upset through said first fluid pressure sealing means when engaged about said tubular and thereby functions as an upper slip.

26. The coupler of claim 25 characterized in that said high pressure sealing means are capable of withstanding fluid pressures in excess of 1,000 psi.

27. The coupler of claim 25 wherein said high pressure sealing means comprise BOP's, RBOP's or annular preventers.

28. A system for connecting and disconnecting tubulars to and from a drill string while continuously circulating a drilling fluid through the drill string comprising:

(a) chamber means for defining a pressure chamber;

(b) multiple inlet and outlet passage means in said chamber for continuously circulating drilling fluid through said chamber and down said drill string;

(c) an upper preventer or BOP or RBOP positioned adjacent the upper portion of said chamber and a lower preventer or BOP or RBOP positioned adjacent the lower portion of said chamber for sealing against the high pressure of the bore hole;

(d) a ram preventer or a blind preventer dividing said chamber into upper and lower portions and for opening and closing fluid flow between said upper and lower chamber portions; and (e) gripping means for moving radially and gripping said tubular or said drill string.

29. An apparatus for use in continuously circulating a drilling fluid down a bore hole while a tubular is added or removed from a drill string comprising:

(a) a pressure resistant casing;

(b) a divider valve dividing said casing into upper and lower chambers;

(c) grips positioned below said divider valve of a size and shape to grip said drill string;

(d) a top drive above said casing; and (e) slips positioned above said divider valve of a size and shape such as not to allow vertical upward movement of said tubular.

30. A system for connecting and disconnecting tubulars to and from a drill string carrying a drill bit while continuously circulating a drilling fluid through the drill string comprising:

(a) chamber means for defining a high pressure chamber;

(b) multiple inlet and outlet passage means in said chamber for continuously circulating drilling fluid through said chamber and down said drill string;

(c) an upper high pressure seal positioned adjacent the upper portion of said chamber and a second high pressure seal positioned adjacent the lower portion of said chamber for sealing against the high pressure in the bore hole during drilling operation;

(d) divider valve means for dividing said chamber into upper and lower portions and for opening and closing fluid flow between said upper and lower chamber portions;

(e) a top drive for rotating the tubulars; and (f) lower rotary grips positioned below said second high pressure seal for gripping said drill string.

31. A coupler for adding or removing tubulars to and from a drill string while continuously circulating drilling fluid down the drill string comprising:

(a) a pressure resistant casing;

(b) said casing including an upper high pressure seal for sealing around a tubular, and a lower high pressure seal for sealing around a drill string;

(c) divider valve means for separating the upper portion of said casing from the lower portion of the casing;

(d) at least one carrier positioned in said casing and mounted for vertical movement; and (e) at least one set of grips carried by said at least one carrier for moving said grips vertically.

32. The coupler of claim 31 further including a second carrier within said casing and mounted for vertical movement below said at least one carrier and including a second set of grips positioned in said second carrier for vertical movement.

33. Apparatus for gripping a tubular or a drill string while the tubular is being added to or removed from the drill string comprising;

(a) a plurality of grips adapted to be moved radially inwardly or outwardly;

(b) a plurality of threaded drive screws;

(c) followers mounted on said drive screws; and (d) links connected between said followers and said grips so as to move said grips into or out of engagement with said tubular or said drill string as said drive screws are rotated in a first or reverse direction, respectively.

34. The apparatus of claim 33 further including a casing, and said drive screws being positioned within said casing.

35. The apparatus of claim 33 including second grips adapted to be moved radially inwardly and outwardly.

36. The apparatus of claim 35 wherein said second grips are driven toward and away from said drill string by an actuating mechanism including drive screws.

37. The apparatus of claim 36 wherein said actuating mechanism includes followers on said drive screws and links connected between said drive screws and said second grips.

38. Apparatus for continuously circulating a drilling fluid through a drill string while a tubular is added to or removed from the drill string comprising:

(a) a pressure resistant casing;

(b) upper and lower high pressure seals positioned so as to seal around a tubular and drill string, respectively;

(c) a divider valve dividing said casing into upper and lower chambers; and (d) at least one rotary grip engaging said drill string and capable of holding stationary or rotating said drill string while a tubular is added or removed from the drill string.

39. The apparatus of claim 38 further including upper slips positioned about said tubular for preventing upward movement of said tubular under the high pressure in said casing during drilling.

40. The apparatus of claim 38 including a second grip positioned above said first-recited grip, and wherein at least one of said grips are motorized to rotate said tubular and said drill string relative to each other.

41. Apparatus for continuing rotation of a drill string in a bore hole while adding or removing tubulars to or from the drill string comprising:

(a) a motorized grip for rotating a tubular into or out of engagement with a drill string;

(b) at least one rotary grip engaging said drill string; and (c) a rotary drive for rotating said rotary grip and said drill string for continuing drilling while tubulars are added or subtracted from said drill string.

42. A coupler for continuing circulation of a drilling fluid down a drill string in a bore hole while connecting or disconnecting a tubular to or from the drill string and while continuing rotation of the drill string in the bore hole comprising:

(a) a casing having an upper and lower chambers;

(b) upper and lower seals connected to said upper and lower portions of said casing and being of a size and shape such as to seal against said tubular and said drill string, respectively;

(c) upper grips positioned to engage said tubular;

(d) rotary grips positioned to engage and grip said drill string; and (e) motor means connected to said rotary grips for continuing the rotation of said rotary grips and said drill string while adding or removing a tubular from said drill string.

43. A system for connecting and disconnecting tubulars to and from a drill string carrying a drill bit while continuously circulating drilling mud through the drill string comprising:

(a) chamber means for defining a high pressure chamber;

(b) multiple inlet and outlet passage means in said chamber for continuously circulating drilling mud through said chamber and down said drill string;

(c) an upper high pressure seal positioned adjacent the upper portion of said chamber and a second high pressure seal positioned adjacent the lower portion of said chamber, said high pressure seals bring capable of sealing against pressures in excess of 1,000 psi during drilling operation;

(d) divider valve means for dividing said chamber into upper and lower portions and for opening and closing the flow of drilling mud between said upper and lower chamber portions;

(e) means for engaging and rotating the tubulars; and (f) means positioned for gripping said drill string and holding or rotating it while adding or removing tubulars and continuously circulating drilling mud down said drill string.

* * * * *